US010151150B2

(12) United States Patent
Blangé et al.

(10) Patent No.: US 10,151,150 B2
(45) Date of Patent: Dec. 11, 2018

(54) INSERT AND METHOD FOR DIRECTIONAL DRILLING

(71) Applicant: SHELL OIL COMPANY, Houston, TX (US)

(72) Inventors: Jan-Jette Blangé, Rijswijk (NL); Paul Anthony Donegan McClure, Aberdeen (GB)

(73) Assignee: SHELL OIL COMPANY, Houston, TX (US)

( * ) Notice: Subject to any disclaimer, the term of this patent is extended or adjusted under 35 U.S.C. 154(b) by 252 days.

(21) Appl. No.: 14/787,960

(22) PCT Filed: Apr. 28, 2014

(86) PCT No.: PCT/EP2014/058566
§ 371 (c)(1),
(2) Date: Oct. 29, 2015

(87) PCT Pub. No.: WO2014/177501
PCT Pub. Date: Nov. 6, 2014

(65) Prior Publication Data

US 2016/0084011 A1 Mar. 24, 2016

(30) Foreign Application Priority Data

Apr. 29, 2013 (EP) ..... 13165802

(51) Int. Cl.
*E21B 10/60* (2006.01)
*E21B 7/04* (2006.01)
(Continued)

(52) U.S. Cl.
CPC ..... *E21B 10/60* (2013.01); *E21B 3/00* (2013.01); *E21B 7/04* (2013.01); *E21B 7/064* (2013.01); *E21B 7/065* (2013.01)

(58) Field of Classification Search
CPC ... E21B 10/60; E21B 3/00; E21B 7/04; E21B 7/064; E21B 7/065
(Continued)

(56) References Cited

U.S. PATENT DOCUMENTS 4,211,292 A 7/1980 Evans
4,637,479 A 1/1987 Leising
(Continued)

FOREIGN PATENT DOCUMENTS

CN 101429848 A 5/2009
EP 0204474 12/1986
(Continued)

OTHER PUBLICATIONS

PCT International Search Report, Application No. PCT/EP2014/058566 dated Jun. 11, 2014.
(Continued)

*Primary Examiner* — Taras P Bemko

(57) ABSTRACT

An insert to convert a conventional rotary drill bit to a rotary steerable bit for a rotational directional drilling system. The insert comprises a cylindrical body adapted to be arranged within an intermediate space of the drill bit for receiving drilling fluid from a drill string and selectively directing the drilling fluid to nozzles of the drill bit. The insert may be rotatable and connected to a geostationary platform. Alternatively, the insert may be fixated in the drill bit, combined with a flow diverter connected to a geostationary platform. The insert is suitable to be introduced in the drill bit at a drilling location, including remote locations and off-shore rigs.

15 Claims, 20 Drawing Sheets

(51) Int. Cl.
*E21B 7/06* (2006.01)
*E21B 3/00* (2006.01)

(58) Field of Classification Search
USPC ..... 175/61
See application file for complete search history.

(56) References Cited

U.S. PATENT DOCUMENTS

| | | | |
|---|---|---|---|
| 5,265,682 | A | 11/1993 | Russell et al. |
| 5,314,030 | A | 5/1994 | Peterson et al. |
| 5,695,015 | A | 12/1997 | Barr et al. |
| 5,959,380 | A | 9/1999 | Gillett et al. |
| 7,419,014 | B2 | 9/2008 | Blange |
| 7,600,586 | B2 | 10/2009 | Hall et al. |
| 2007/0221409 | A1 | 9/2007 | Hall et al. |
| 2009/0183921 | A1 | 7/2009 | Gurjar et al. |
| 2013/0043874 | A1* | 2/2013 | Clark ..... E21B 10/00 324/369 |
| 2013/0098686 | A1 | 4/2013 | Wentworth |

FOREIGN PATENT DOCUMENTS

| | | |
|---|---|---|
| GB | 2257182 | 1/1993 |
| GB | 2284837 | 2/1994 |
| WO | 02091554 | 11/2002 |
| WO | 2012084934 | 6/2012 |

OTHER PUBLICATIONS

PCT International Search Report, Application No. PCT/EP2014/058568 dated Jun. 26, 2014.
PCT International Search Report, Application No. PCT/EP2014/058572 dated Jun. 26, 2014.

* cited by examiner

INSERT AND METHOD FOR DIRECTIONAL DRILLING

CROSS-REFERENCE TO RELATED APPLICATIONS

The present application is a National Stage (§ 371) of International Application No. PCT/EP2014/058566, filed Apr. 28, 2014, which claims priority from European Application No. 13165802.3, filed Apr. 29, 2013, the disclosures of each of which are hereby incorporated by reference in their entirety.

The present invention relates to a method and system for directional drilling. The system and method are for instance applicable for controlling the direction of a borehole in a subsurface formation. The borehole may be for the production of hydrocarbons.

For various reasons it may be desirable to control the drilling direction to provide a borehole along a predetermined trajectory. Controlling the direction herein refers to the intentional deviation of a borehole from the path it would naturally take. Thus, the borehole may include curved sections and extend at least partially horizontally, rather than extend substantially straight down. In some cases, such as when drilling through steeply dipping formations or an unpredictable subsurface environments, directional-drilling techniques may be employed to ensure that the borehole is drilled along the appropriate trajectory.

Conventionally, directional drilling may be accomplished by using whipstocks, directionally-biased bottomhole assembly (BHA) configurations, instruments to measure the path of the borehole in three-dimensional space, data links to communicate measurements taken downhole to the surface, mud motors and special BHA components and drill bits, including rotary steerable systems, and drill bits. An operator, often referred to as the directional driller, may also exploit drilling parameters such as weight on bit and rotary speed to deflect the bit away from the axis of the existing borehole.

Rotational drilling may use rotatable drill bits which are provided with mechanical cutters, such as roller-cone bits or polycrystalline diamond compact cutters (PDC bits). During drilling, these bits are typically rotated, for instance by rotating the entire drill string using a drive system at surface, such as a Kelly of top drive, or by a downhole mud motor near the bit. During rotation, these bits produce cuttings by crushing and/or scraping at the borehole bottom and at the sides.

Many techniques are available to accomplish directional drilling. The general concept is to point the bit in the direction that one wants to drill. The most common method uses a bend sub near the bit in combination with a downhole mud motor. The bend sub points the bit in a direction slightly off the axis of the borehole. By pumping mud through the mud motor while the drillstring does not rotate, the bit will rotate and drill in the direction it is oriented to, which is determined by the bend of the bend sub section. On the other hand, by rotating the entire drillstring (including the bent sub section) the bit will sweep around and the net drilling direction coincides with the axis of the borehole, resulting in a straight trajectory. Sweeping the bit around will typically result in increased bit wear however.

Rotary steerable systems allow steering while rotating, usually with higher rates of penetration and ultimately smoother boreholes. Rotary steerable systems (RSS) can deviate the borehole while the drill string rotates. Known rotary steerable systems may for instance point the mechanical drill bit in a certain direction using a complex bending mechanism or may push the drill bit to a particular side using expandable thrust pads. A side-cutting ability of the mechanical drill bit may then allow deviation of the borehole in the desired direction. For example, PDC bits have cutters not only on the front end but also at the sides.

Directional drilling allows drillers to direct the borehole towards the most productive reservoir rock and to drill horizontal sections. Directional drilling is for instance common in shale reservoirs and other sources of unconventional hydrocarbons.

Some directional drilling systems and methods use drill bits wherein the nozzles are specially adapted so as to obtain a directional drilling effect.

U.S. Pat. No. 4,211,292 discloses a roller cone drill bit having a nozzle extension, located at a position normally occupied by a conventional wash nozzle. The extended jet nozzle may emit pressurized fluid onto the gage corner of the borehole being drilled. Pressurized fluid is selectively conducted to the jet emitting nozzle during a predetermined partial interval of one drill bit rotation, so as to increase cutting of the gage corner in a certain azimuthal sector of the borehole, thereby deviating the borehole towards that sector.

GB-2284837 discloses a roller cone drill bit, in which one of three nozzles is modified to direct fluid flow into the corner of the interface between the bit and the formation, so that the flow of drilling fluid is asymmetric relative to the bit. The flow of drilling fluid is pulsed so that the flow is high in a certain azimuthal position and low for the remainder of the rotation, so as to preferentially drill in a selected direction.

U.S. Pat. No. 4,637,479 discloses a roller cone drill bit, which is modified so that it sealingly co-operates with a fluid-direction means for sequentially discharging fluid streams through nozzles only into a selected sector of the borehole. A rotating disc is provided with a port to direct fluid through a selected sector, including one or two of a number of fluid nozzles of the drill bit. During rotation of the drill string including the drill bit, fluid communication through one or two nozzles outside the selected sector of the borehole is blocked, and in this way it is achieved that the drill bit is diverted.

U.S. Pat. No. 5,314,030 discloses a system for directional drilling. An orientation sensor on the drill string detects deviation of the drilling direction. The drill string also includes a rotational tiltmeter, including a mechanical oscillator such as a pendulum. The drill bit is steerable by preferentially directing flushing fluid at the drilling end. A fluid modulation means controls the flushing in response to a signal from the orientation sensor. The fluid modulation means may include a rotating disc or an oscillating valve plate. In a steering mode, a motor may rotate the disc at still pipe rpm so the disc remains stationary with respect to the borehole. If no steering effect is desired, the disc is stopped over one of three fluid passages so that one flushing jet rotates with the drill string. Herein, conical portions of the borehole bottom in conjunction with preferential hole bottom flushing provide controlled lateral penetration. The conical portions of the borehole bottom are the consequence of a special conical shape of mechanical cutters of the drill bit.

US-2007/0221409 discloses a system including a turbine provided with vanes driven by drilling fluid.

Subsequently, part of the drilling fluid is directed through a rotary valve comprising two discs including corresponding fluid openings which can be controlled to be aligned and thus allow fluid to pass to a fluid nozzle, or not thus blocking the fluid flow. Using the rotary valve, fluid pulses may be provided by the nozzle, thereby eroding the formation along a selected azimuth.

U.S. Pat. No. 7,600,586 discloses a downhole tool string component, having a first rotor secured within a bore of the component and connected to a gear assembly. The gear assembly is mechanically connected to a second rotor. The second rotor is in magnetic communication with a stator which has an electrically conductive coil, being in communication with a load. Sensors collect data, which is used to adjust the rotational speed of a turbine of the assembly of second rotor and stator, in order to control a jack element. The jack element has an asymmetric tip which may be used to steer the drill bit and therefore the drill string.

The system of U.S. Pat. No. 7,600,586 however will lose positional control during stick-slip situation. Herein, stick-slip refers to the sticking of the bit to the formation during drilling, effectively halting rotation while the drill string continues to rotate. The stick phase is followed by a slip phase, wherein the bit spins several times at an increased rotational speed with respect to the drill string. Due to the coupling of the stator to the drill string, and the magnetic coupling between the second rotor and the stator, the sensors may lose the proper orientation with respect to the formation. In addition, the first rotor is driven by the drill fluid and rotates at the speed of the drill string, for instance in the range of 40 to 60 RPM. At such relatively low speed it is difficult to accurately control the rotation of the rotor. The latter for instance requires the first rotor to be relatively large with respect to the drill string.

The known methods require substantial modifications to conventional drill bits, such as nozzle modifications, implementation of rotating seals, or specially shaped cutters. The required modifications to drill bits however reduce the choice of drill bits, which typically drives up costs and which is generally undesirable. In addition, to limit tripping in and out of the borehole the modified drill bit will also have to be used for drilling straight sections of the trajectory, even though the bit may be less efficient then conventional drill bits. Rotating seals or valves are typically vulnerable and may severely limit the reliability of downhole equipment.

The present invention aims to provide a more robust and cost efficient directional drilling method and system.

The invention provides an insert for a drill bit of a directional drilling system, the insert comprising:

a cylindrical body adapted to be arranged within an intermediate space of the drill bit for receiving drilling fluid from a drill string and selectively directing the drilling fluid to nozzles of the drill bit.

The insert allows to convert a conventional rotary bit into a steerable rotary bit for use in combination with a directional rotary drilling system. Such system allows directing fluid flow which is decoupled from the rotation of the drill string. The insert of the invention obviates specially designed bits and thus allows for significant cost savings. Besides, the conversion of the drill bit can be applied at the location of a drilling rig. As conventional drill bits are readily available, the insert may in addition provide significant time savings. For instance, when a driller would unexpectedly choose to drill a curved section of the borehole, the insert of the invention allows to convert the conventional tools which are available.

According to another aspect, the invention provides a method for directional drilling of a borehole in a formation, the method comprising the steps of:

inserting an insert in an intermediate space of a drill bit, the insert comprising a cylindrical body for receiving drilling fluid from a drill string and selectively directing the drilling fluid to nozzles of the drill bit.

The invention is based on the insight gained by applicant that fluid flow through each nozzle influences drilling performance, and that merely a relatively small distortion of the normal fluid flow pattern from bit nozzles is needed in order to achieve a directional drilling effect. Therefore flow through a particular nozzle can be maintained throughout the rotation, and a modification such as a modulation of the flow with the frequency of rotation is sufficient. This eliminates the requirement for rotating seals, selectively blocking fluid flow through nozzles. It also allows the use of conventional drill bits without a modification of the nozzle configuration, i.e. the nozzles can still be optimally, such as symmetrically, arranged, as desired for a particular drill bit configuration.

In an embodiment, the insert may rotate together with the drill bit.

In an embodiment, the directional drilling tool of the invention can be retrieved to surface. This allows selective directional drilling operation capability only when that is desired, without the need to retrieve the drill string to exchange the drill bit or parts of the bottom hole assembly.

The invention will be described herein below in more detail, and by way of example, with reference to the accompanying drawings in which:

FIG. 1 shows a cross-sectional side view of a borehole including an embodiment of the system of the invention;

FIG. 2 schematically shows a cross-section in plan view of an electromagnetic brake arrangement for the system of the invention;

Figure 1:
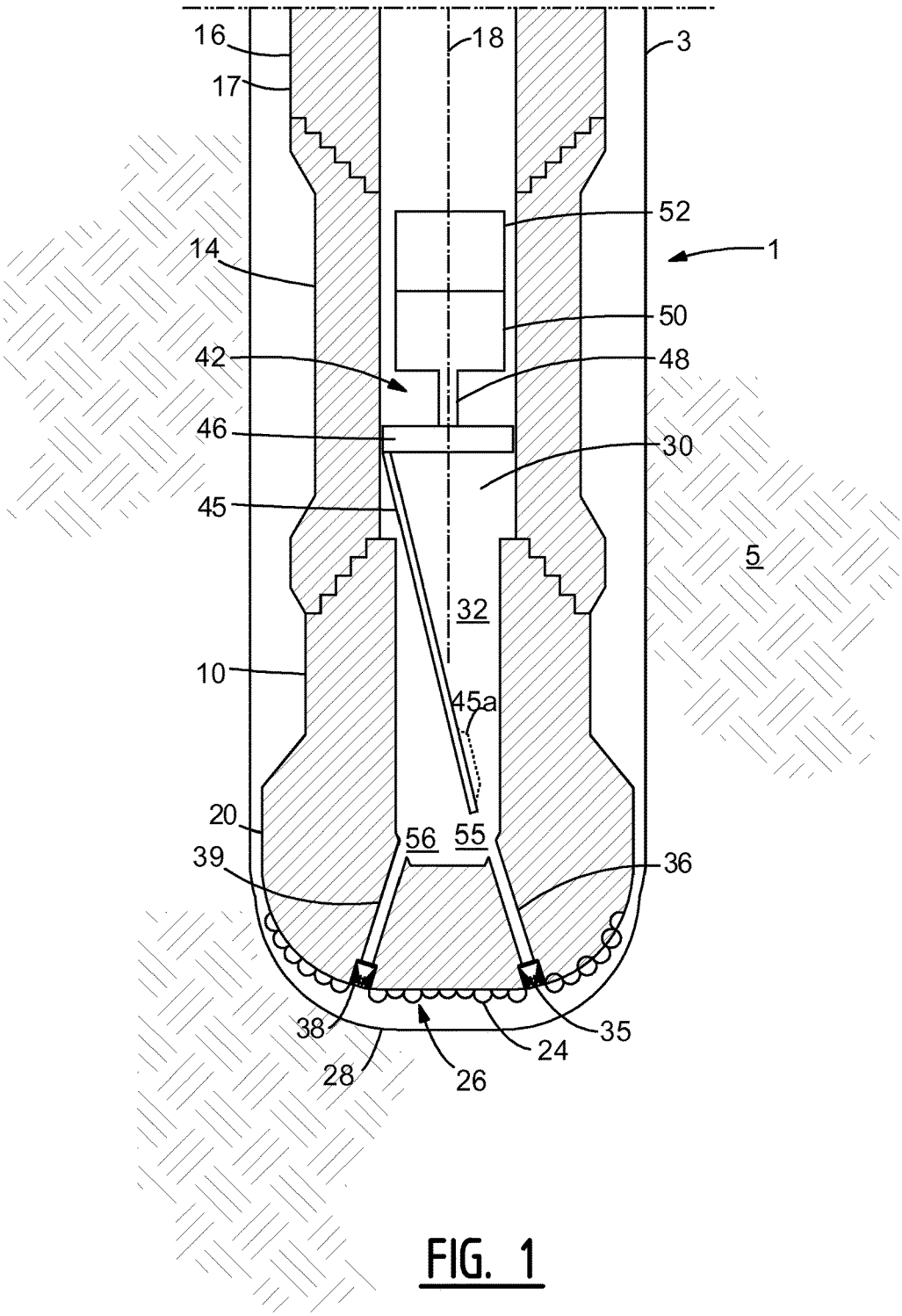
Figure 5:
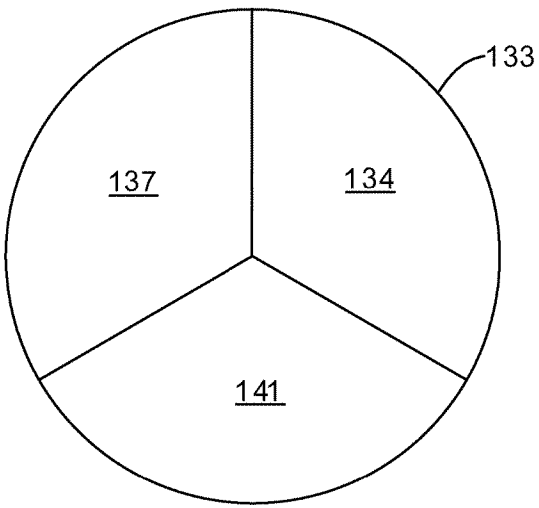
Figure 4:
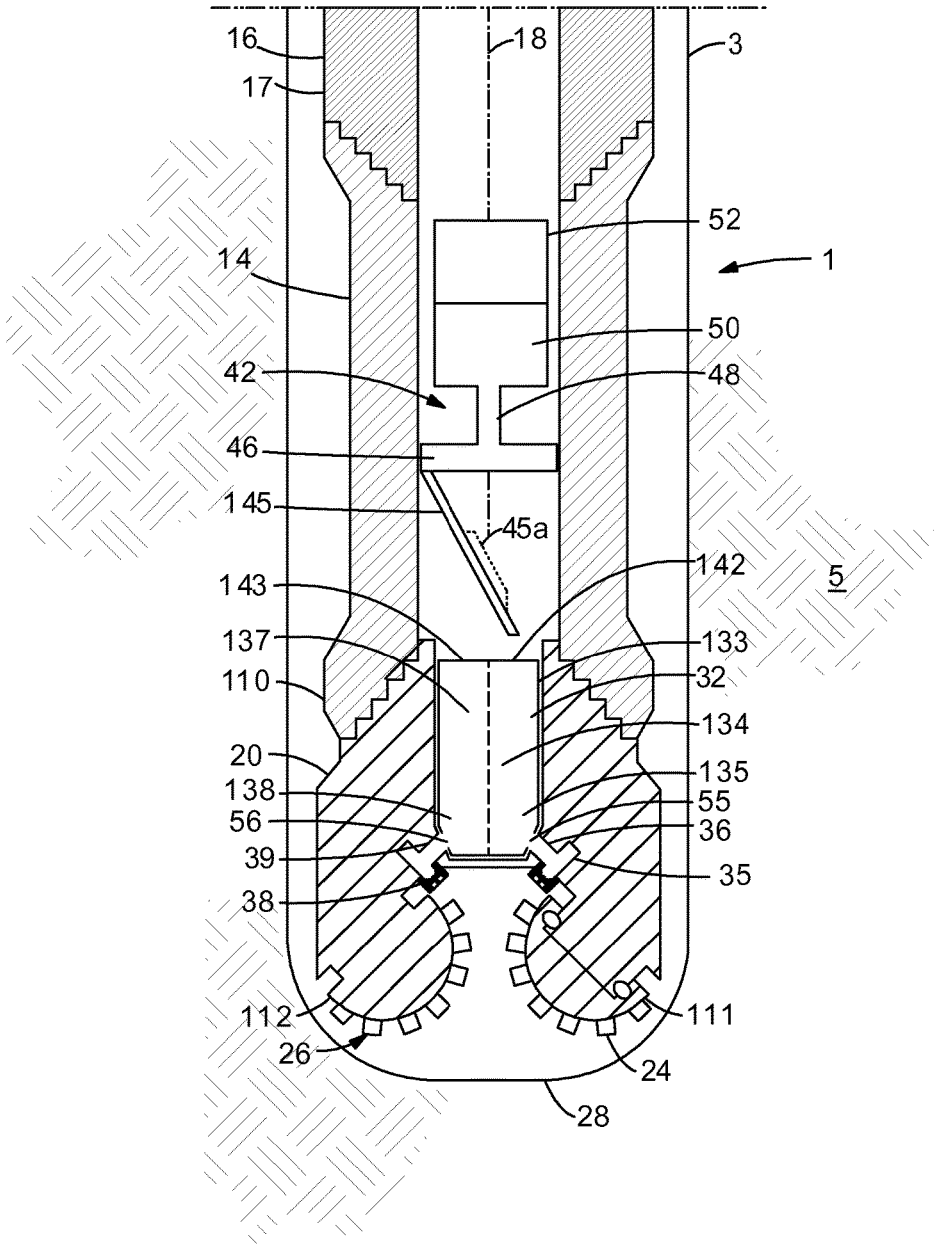
FIG. 4 shows a cross-sectional side view of a borehole including another embodiment of a system of the invention.
Figure 6:
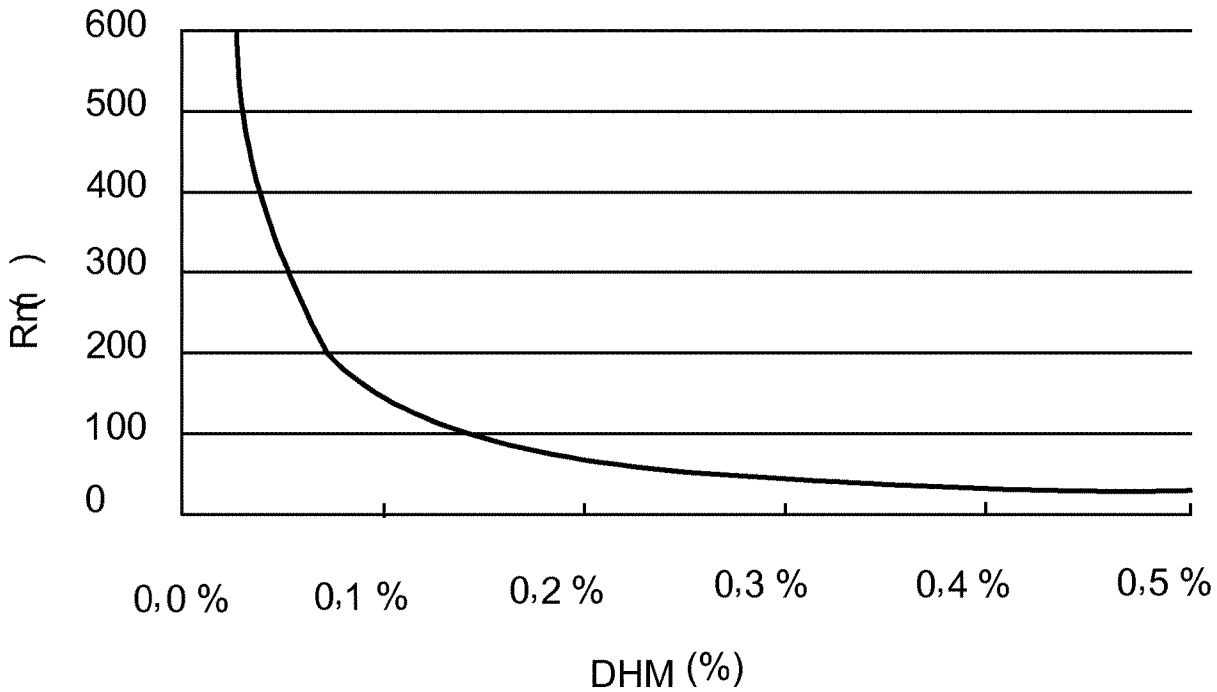
Figure 7A:
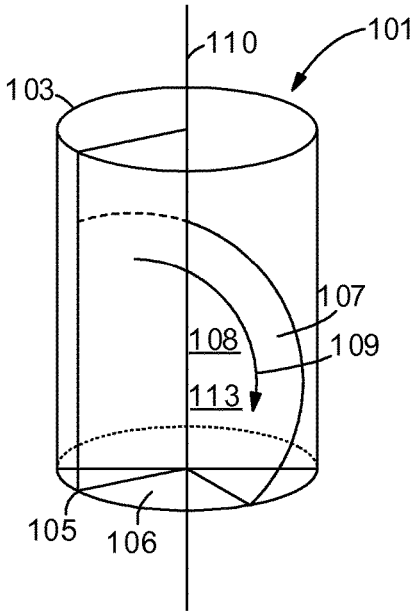
Figure 7B:
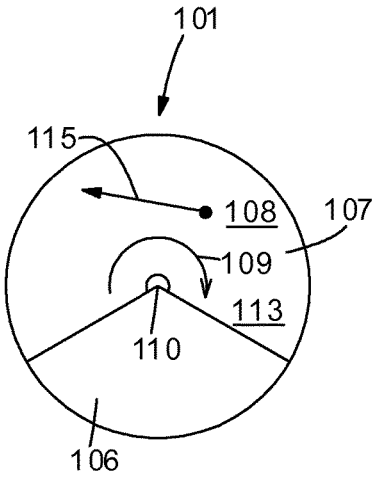
Figure 8:
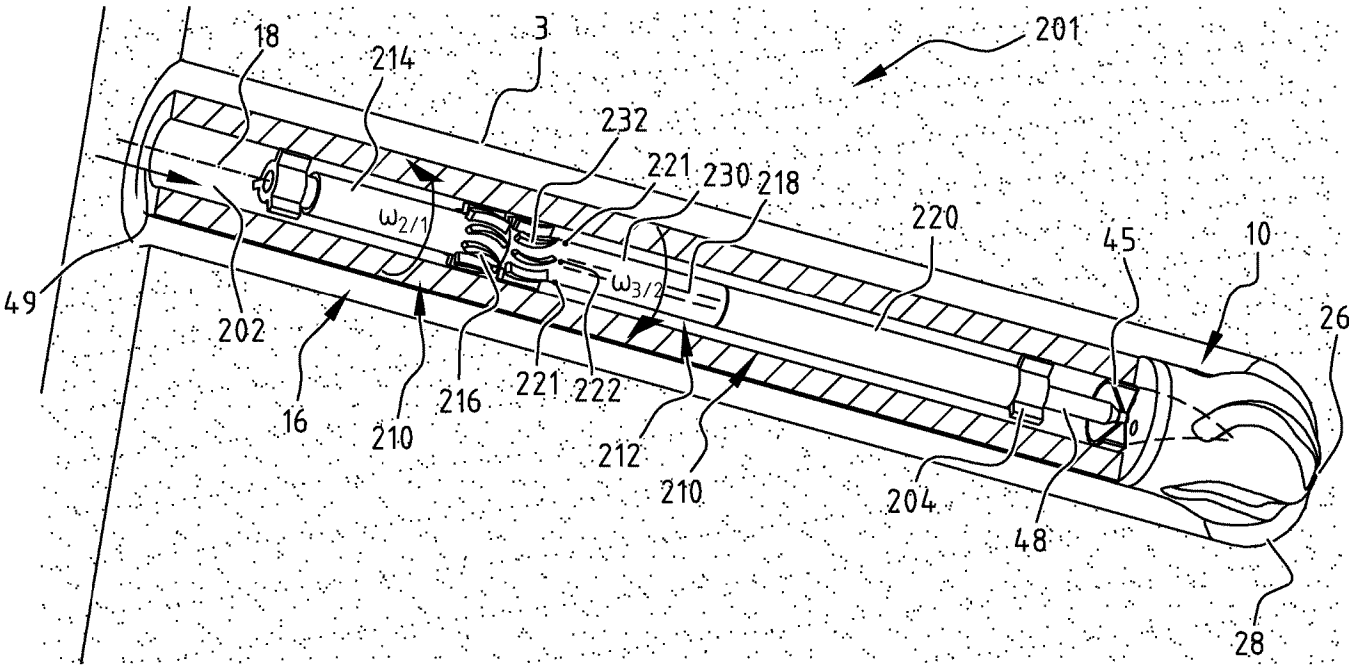
Figure 9A:
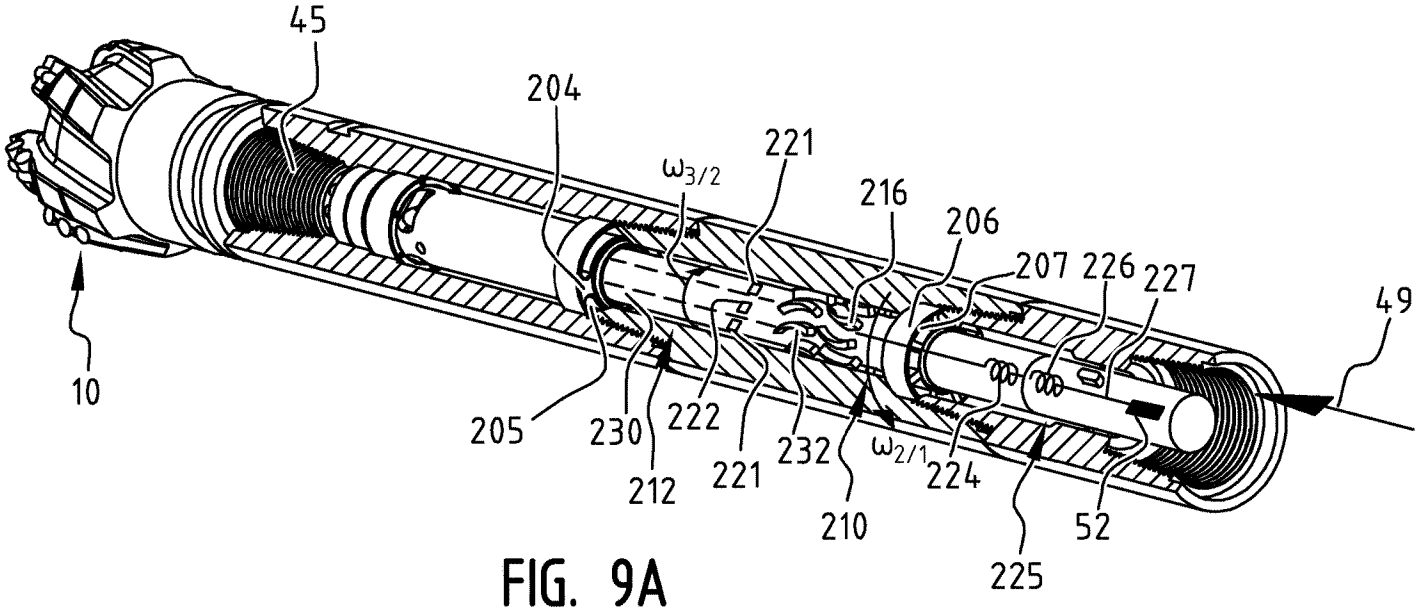
Figure 9B:
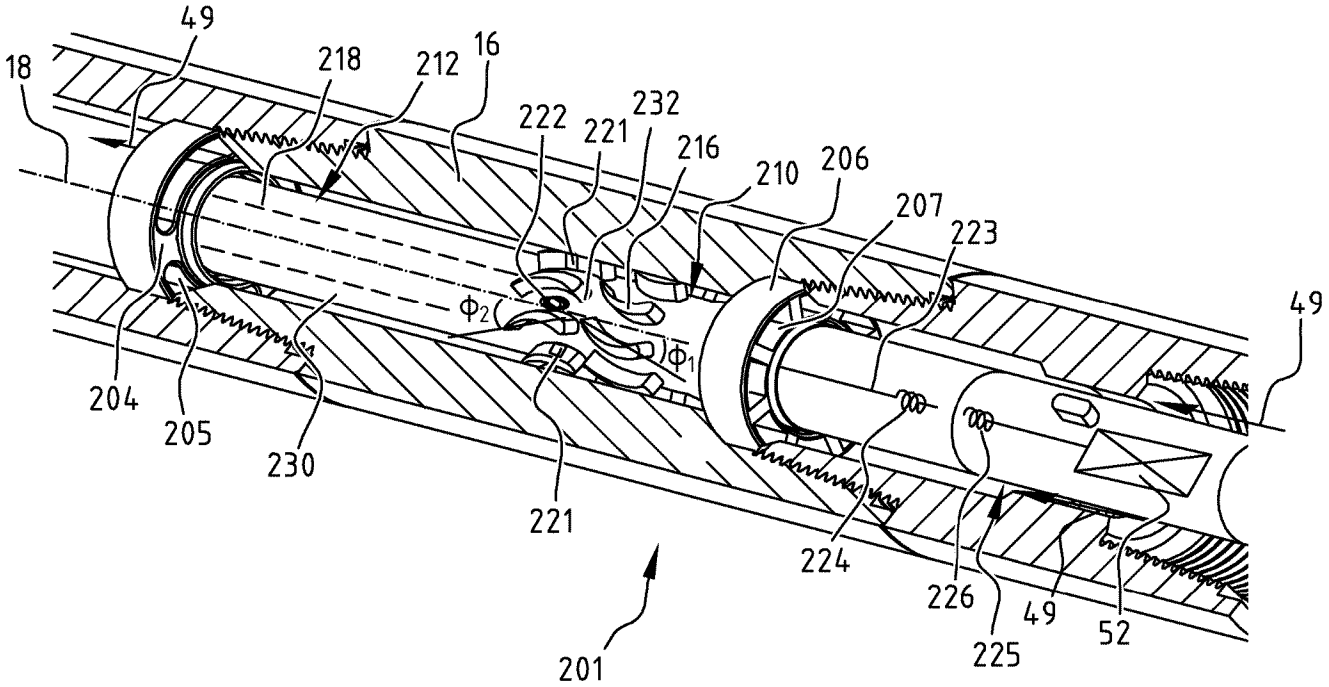
Figure 9C:
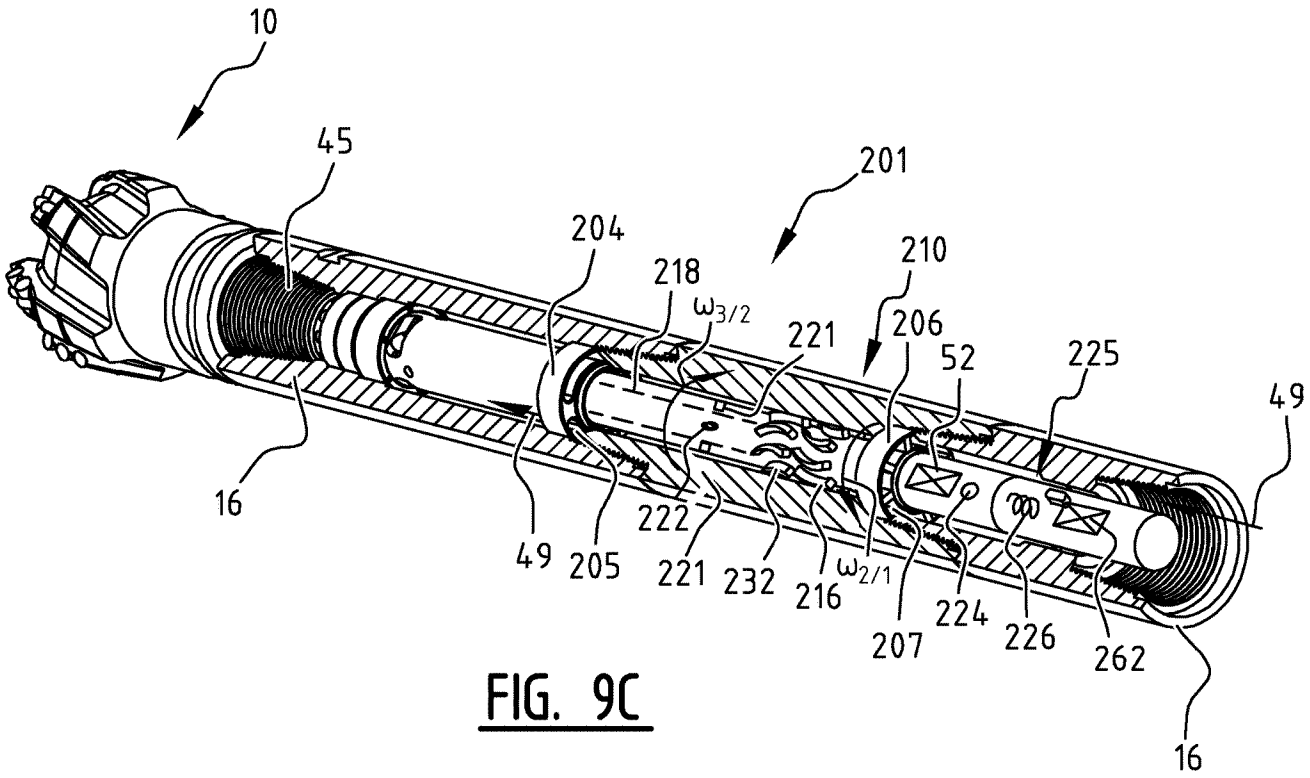
Figure 9D:
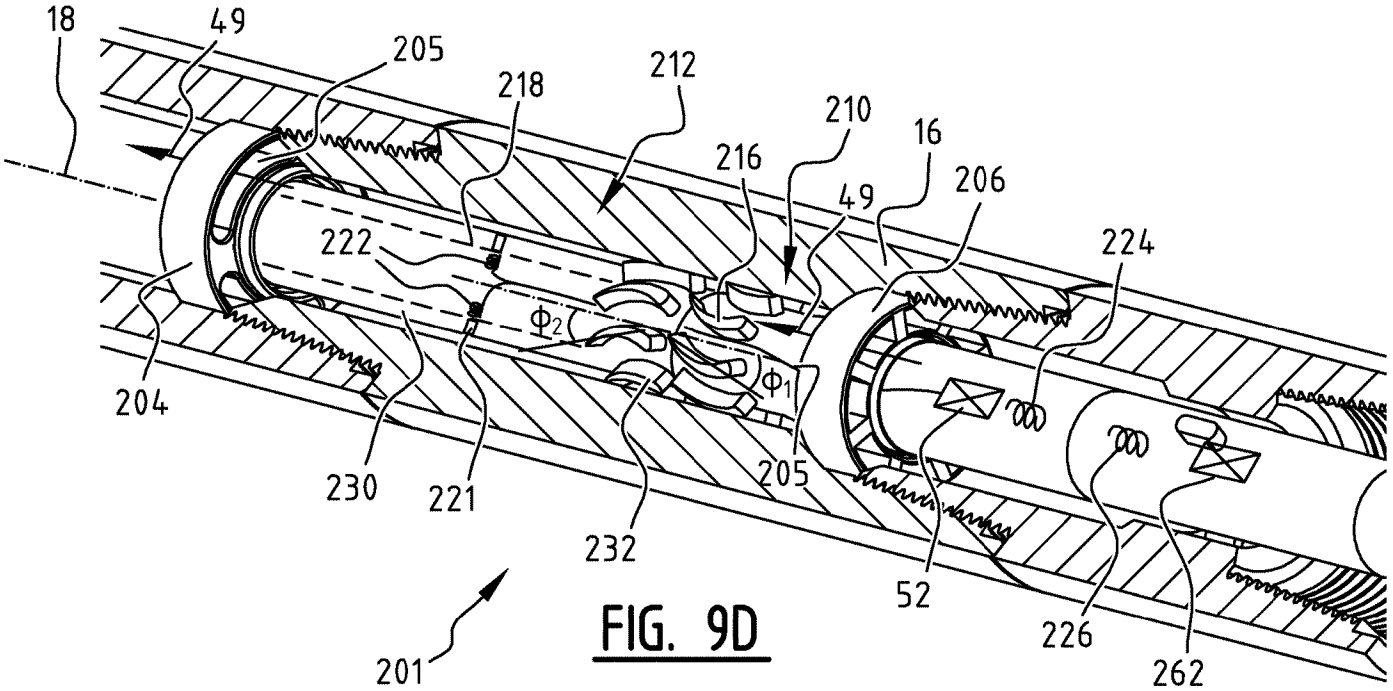
Figure 10:
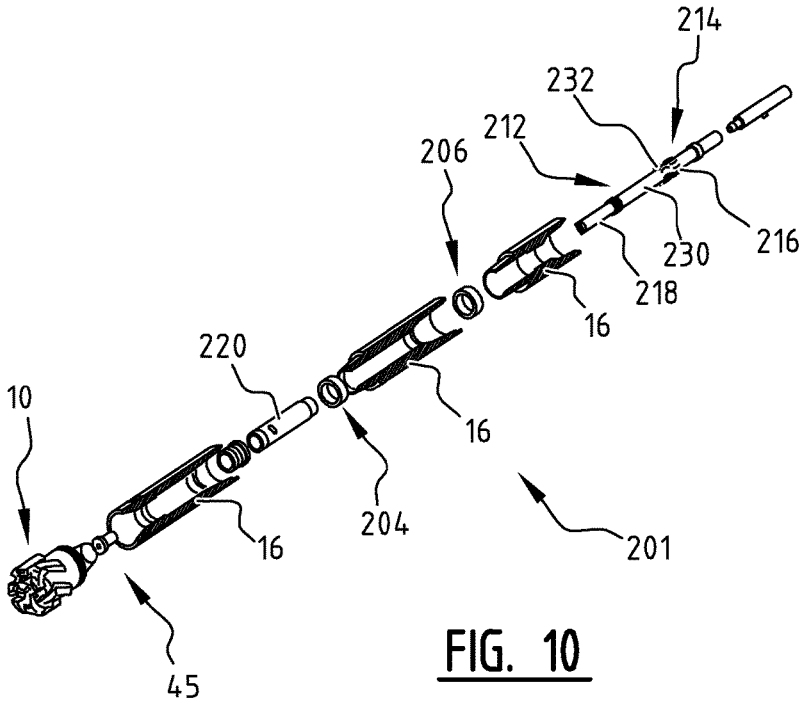
Figure 11:
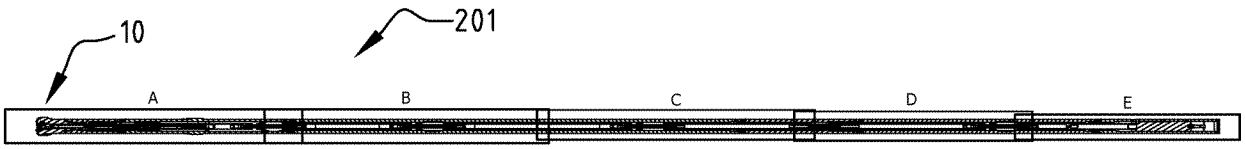
Figure 12A:
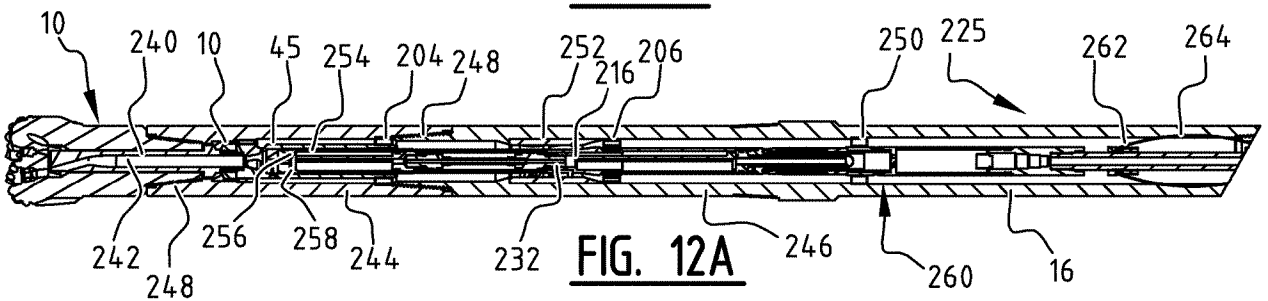
Figure 13:
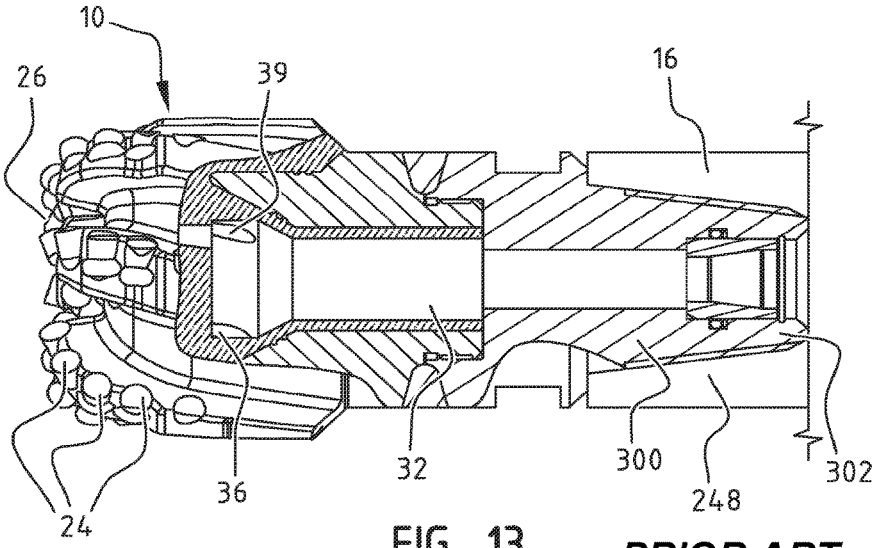
FIG. 13 PRIOR ART
Figure 14A:
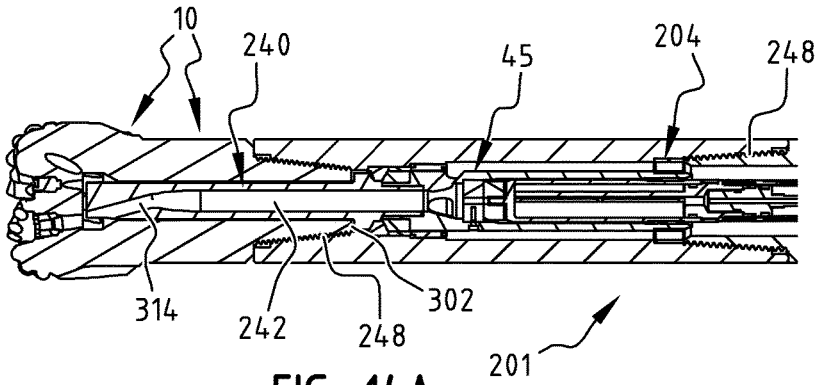
Figure 14B:
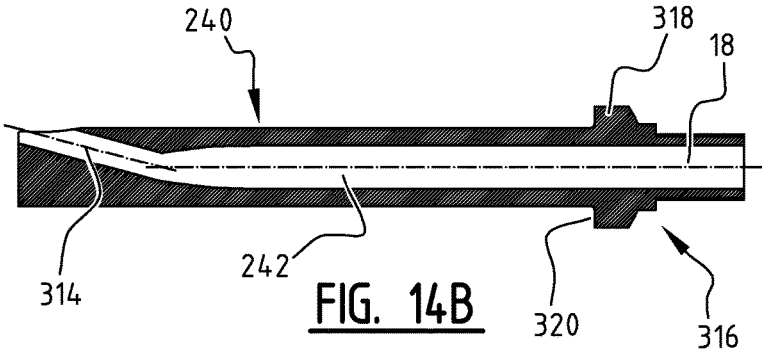
Figure 14C:
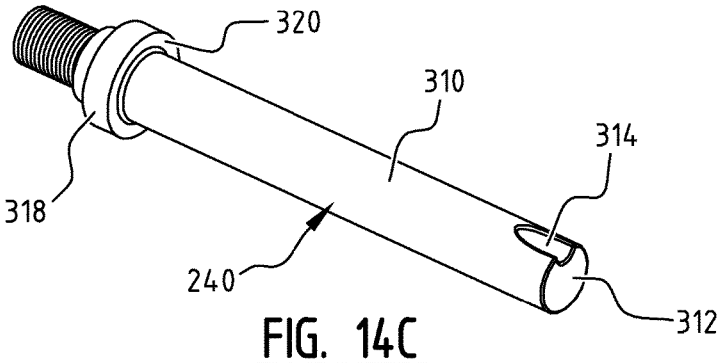
Figure 15A:
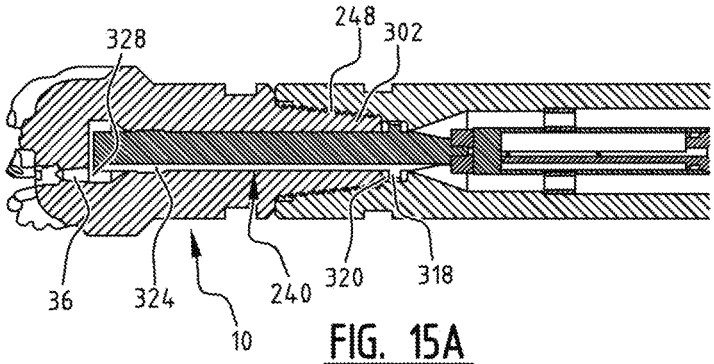
Figure 15B:
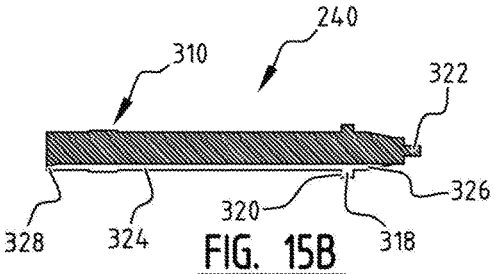
Figure 16B:
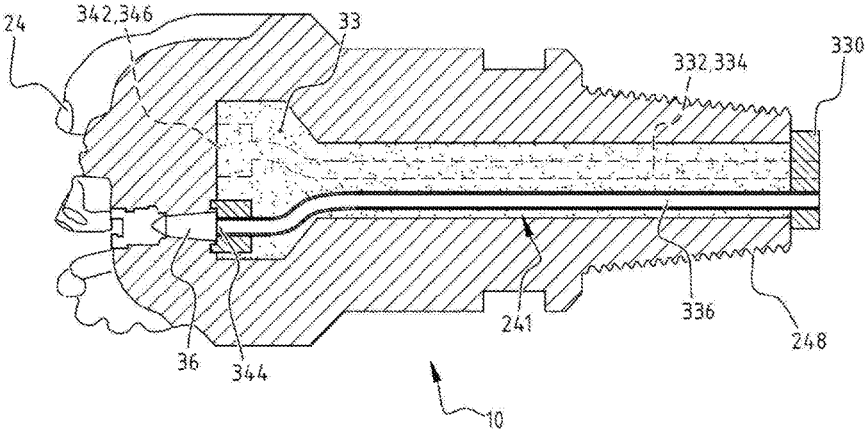
Figure 16A:
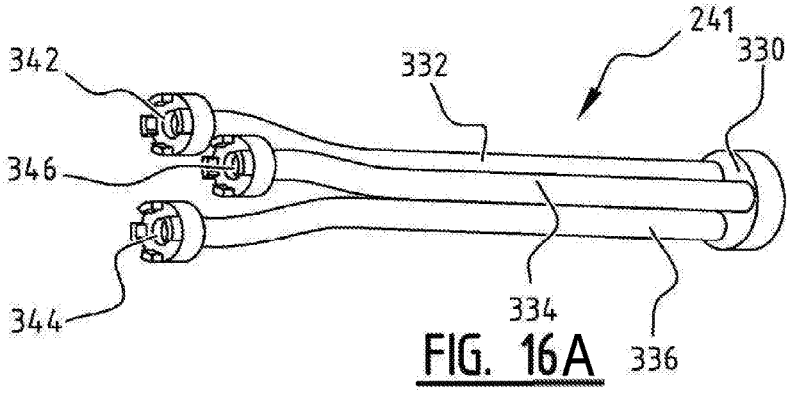
Figure 17:
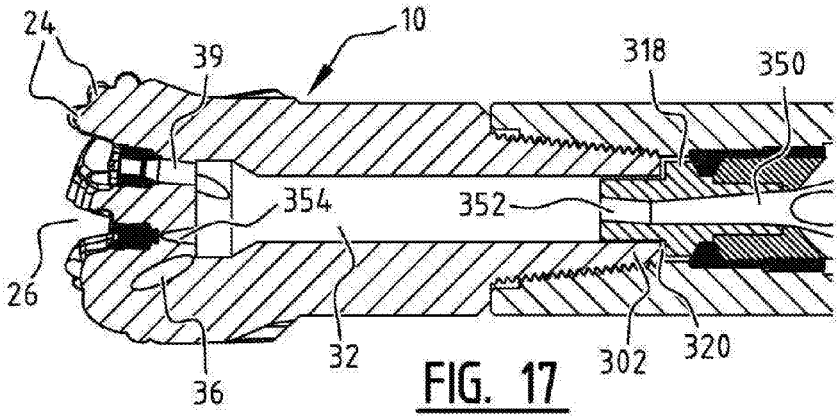
Figure 18:
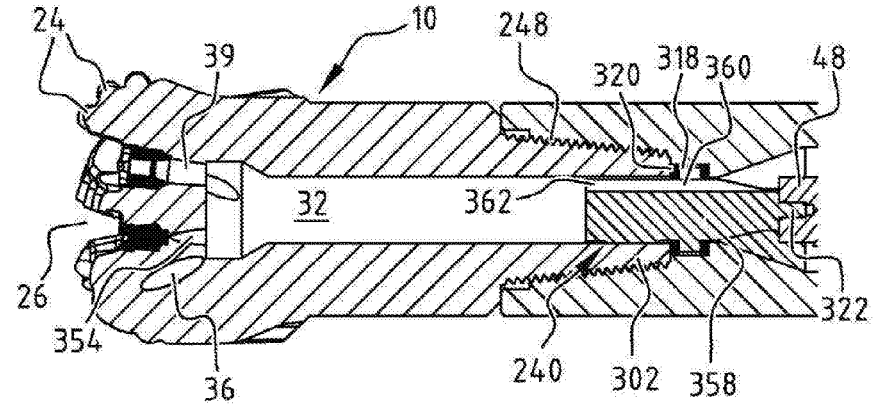
Figure 19:
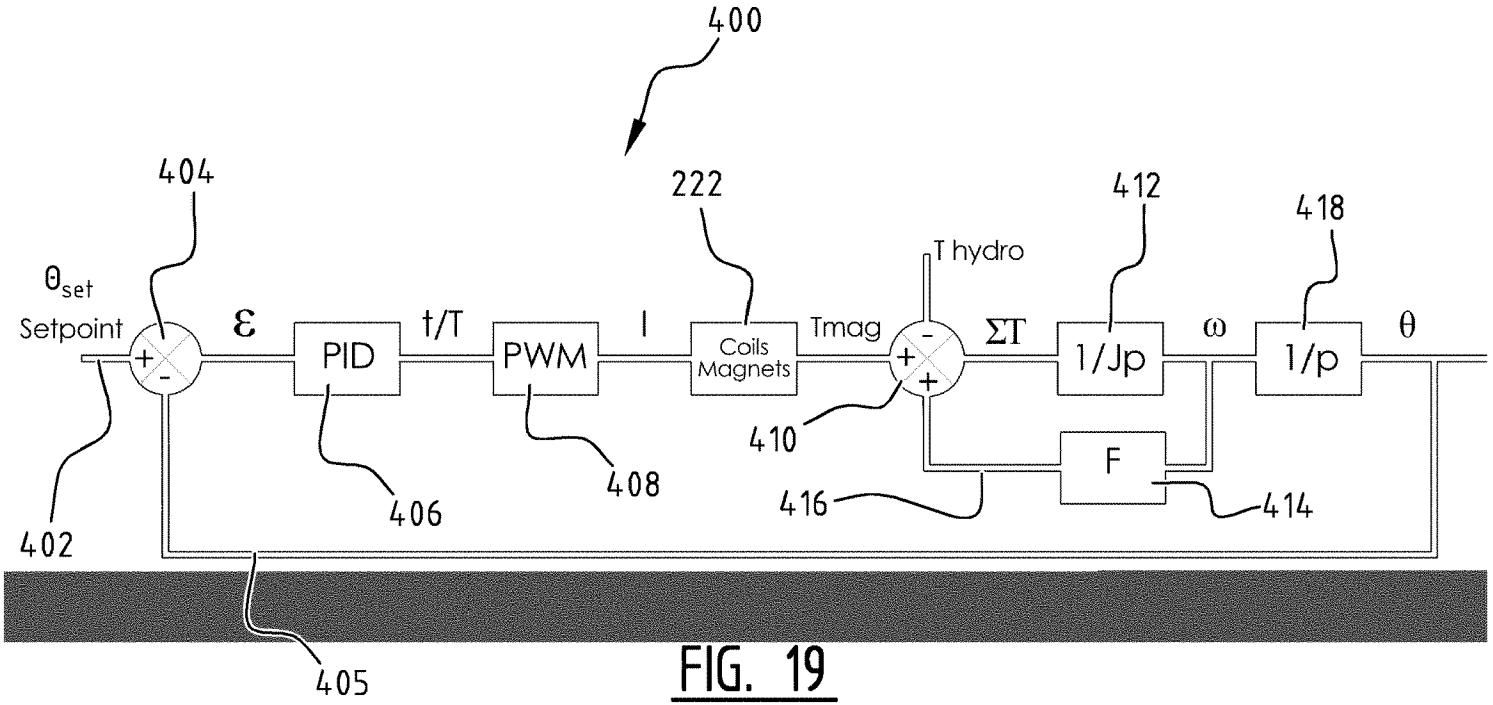
Figure 20:
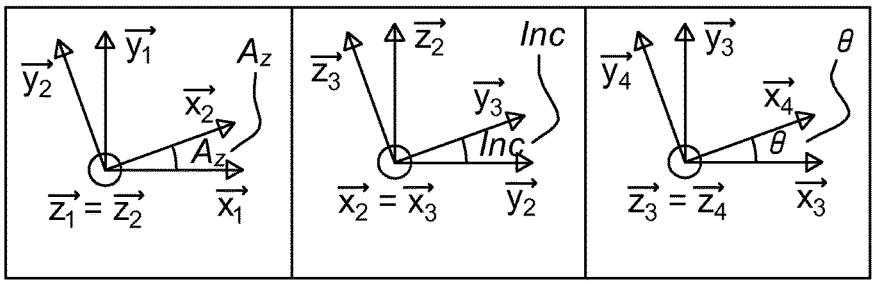
Figure 21:
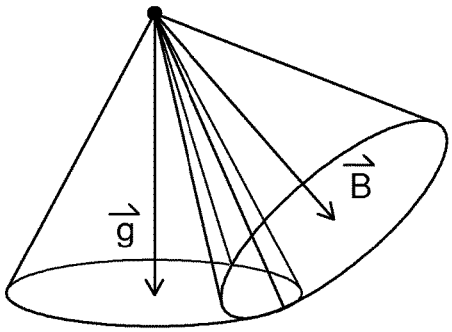

FIG. 5 schematically shows a cross-sectional plan view of a flow guide of the system of FIG. 4;

FIG. 6 shows the result of a model calculation of drilling radius in dependence of a differential hole making (DHM) effect;

FIGS. 7A and 7B schematically show an embodiment of a deflection means alternative to outlet member 45 in FIGS. 1 and 4, in perspective view and top view respectively;

FIG. 8 shows a perspective view of an embodiment of a rotational drilling system according to the invention;

FIG. 9A shows a perspective view of an embodiment of a rotational drilling system according to the invention from another angle;

FIG. 9B shows a details of FIG. 9A;

FIG. 9C shows a perspective view of another embodiment of a rotational drilling system according to the invention;

FIG. 9D shows a details of FIG. 9C;

FIG. 10 shows an exploded perspective view of an embodiment of a rotational drilling system according to the invention;

FIG. 11 shows a cross-sectional side view of an embodiment of a rotational drilling system according to the invention;

FIGS. 12A to 12E show a cross-sectional side view of respective details of the embodiment of FIG. 11;

FIG. 13 shows a cross-sectional side view of a conventional PDC drill bit;

FIG. 14A shows a detail of the embodiment of FIG. 12A;

FIG. 14B shows a cross-sectional side view of an embodiment of an insert for a drill bit;

FIG. 14C shows a perspective view of the insert of FIG. 14B;

FIG. 15A shows a cross-sectional side view of a downhole end of a drill string, including a drill bit provided with another embodiment of an insert;

FIG. 15B shows a cross-sectional side view of the insert of FIG. 15A;

FIG. 16A shows a perspective view of another embodiment of an insert for use in combination with the rotational drilling system of the invention;

FIG. 16B shows a cross-sectional side view of a drill bit provided with the insert of FIG. 16A;

FIG. 17 shows a cross-sectional side view of a downhole end of a drill string including a flow diverter and a drill bit provided with yet another embodiment of an insert;

FIG. 18 shows a cross-sectional side view of a downhole end of a drill string including another flow diverter and a drill bit provided with still another embodiment of an insert;

FIG. 19 shows a diagram of an embodiment of a control loop for controlling the rotational drilling system of the invention;

FIG. 20 shows three diagrams, indicating respective vector changes in reference frames and terminology used in this respect; and FIG. 21 shows a diagram indicating an example of a gravitational vector g and a magnetic vector B.

In the Figures, like reference numerals relate to the same or similar components.

FIG. 1 shows an embodiment of a system 1 for directional drilling a borehole 3 in an earth formation 5 in accordance with the invention. The system 1 comprises a drill bit 10 connected to a sub 14, which is a part of of drill string 16 extending to surface. A relatively heavy drill collar section 17 may be included in the downhole end section of the drill string, and is shown connected to the upper end of sub 14. The longitudinal axis of drill string 16 as well as drill bit 10 is indicated as 18. The drill string is generally made up of interconnected pipe sections or similar drill string elements.

The drill bit 10 as shown in this embodiment is a polycrystalline diamond compact cutters (PDC) bit. Other drill bit types such for example a roller-cone may also be used. The PDC bit shown in FIG. 1 comprises a bit body 20 provided with mechanical cutting means in the form of PDC cutters 24. The cutters form a bit face 26. During operation, said bit face is facing and positioned near the borehole bottom 28. The drill bit 10 is typically provided with an inlet port 30 for receiving drilling fluid from the drill string element, for instance from sub 14. The port 30 is the inlet to intermediate space 32, from which a plurality of inlet channels to nozzles for ejecting drilling fluid extend. In this example a first nozzle 35 with first inlet channel 36 and a second nozzle 38 with second inlet channel 39 are provided. The first and second nozzles are arranged at different azimuthal positions with respect to the bit face, in this example 180 degrees apart, as counted with respect to rotation of the drill string 16 along its longitudinal axis.

A flow directing means 42 may be arranged in the sub 14. The flow directing means may comprise an outlet member 45, connected via support member 46 and shaft 48 to a rotation means schematically shown as 50. The flow directing means may be controlled by control unit 52, for controlling relative rotation of the outlet member with respect to the drill bit 10. The support member 46 is arranged such that it allows drilling fluid to pass down the interior of the drill string towards the inlet port 30. The outlet member 45 may be a flow diverter. The flow diverter may comprise a flat plate, but it can also have other shapes such as a curved lip or a channel. The outlet member 45 may extend via the inlet port 30 into the intermediate space 32. Thus, the outlet member delivers drilling fluid in a direction towards a first area 55 of the intermediate space 32.

As shown in FIG. 1, the first inlet channel 36 to first nozzle 35 extends from the first area 55, and the second inlet channel 39 to second nozzle 38 extends from the second area 56 which second area is outside of the area towards which drilling fluid is directed. When the drill string 16 has rotated by 180 degrees, and the outlet member 45 remains geostationary, then the second inlet channel 39 to second nozzle 38 extends from the first area 55. Areas 55 and 56 are regarded as geostationary.

The control unit 52 is adapted to obtain orientation data, such as from external, connected or integrated measurement devices, e.g. MWD devices, and/or via communication with an external data source, e.g. at surface. From actual and desired orientation data for the outlet member it is determined, which relative rotation of the outlet member with respect to the drill string is needed.

When the drill string 16 rotates in one direction, say clockwise, a rotation in the opposite direction relative to the drill string would be required for the outlet member to remain geostationary. The rotation means 50 can for example be an active drive motor. Another option is shaping a part of the flow direction means 42, such as the support member 46 or outlet member 45, such that it is driven by the flow of drilling fluid 49 into an opposite rotation relative to the drill string. In the latter case, control over the direction of the flow diverter can be achieved by way of a controlled brake that slows the left hand rotation to such an extent that the right hand rotation of the drill string is compensated and the flow diverter points into a fixed direction relative to earth.

Figure 2:
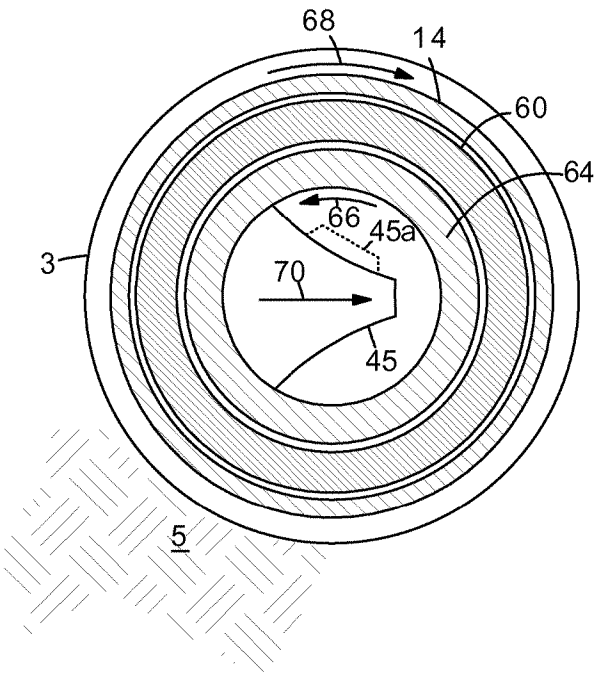

FIG. 2 shows a schematic electromagnetic brake arrangement for the rotation means. Within the sub 14 a stator 60 is arranged, which is rotatably locked to the sub 14. The stator can also be integrally formed with the sub. A rotor 64 is rotatably arranged with respect to the stator 60/sub 14. The rotor 64 comprises means, for instance a vane, fin or rib, exerting a torque when fluid flows along and is deflected, so as to rotate the rotor relative to the stator 60 when drilling fluid flows down the sub 14. One option for such means is schematically indicated by lip 45*a* which extends with respect to outlet member 45. The relative rotation of the rotor 64 is indicated by arrow 66. The rotation of the sub 14 in the borehole 3 during drilling, together with stator 60, is indicated by arrow 68.

Stator 60 and rotor 64 together may form an electromagnetic generator, in particular one of stator and rotor comprising a permanent magnet arrangement and the other comprising an electromagnetic coil arrangement. For example, the stator can comprise the permanent magnet arrangement, and the rotor the electromagnetic coil arrangement interacting with the permanent magnet arrangement during relative rotation. This creates a voltage over electrical poles of the electromagnetic coil arrangement, and thereby electrical energy. The electrical energy can be dissipated in a load. The load can for instance be a resistor. Instead of dissipating the energy as heat, it can also at least partly be used for powering other electrical equipment, directly or by loading a battery.

By changing the load, such as a resistor connected to the electrical poles, the resistance to rotation can be controlled. Thus, the electromagnetic brake can be adjusted such that the rotations 64 and 68 compensate each other, so that the rotor 64—to which the outlet member 45 of the embodiment of FIG. 1 is connected—remains geostationary. The outlet member causes a flow diversion of drilling fluid in the direction 70.

The flow directing means 42 in this embodiment can be retrieved to surface upwardly through the interior of the drill string 16. To this end, for example, the rotation means 50 and/or control unit 52 may be provided with a fishing neck.

During directional drilling, the drill string 3 is rotated together with the drill bit 10. Drilling fluid is passed down the drill string to and through the first and second nozzles 35, 38. The flow diverter, outlet member 45, is kept geostationary by the operation of the control unit 52 and rotation means 50, so that drilling fluid is directed with higher momentum to the first area 55 of the intermediate space 32, which leads to a higher momentum of fluid flow exiting the respective nozzle.

Figure 3B:
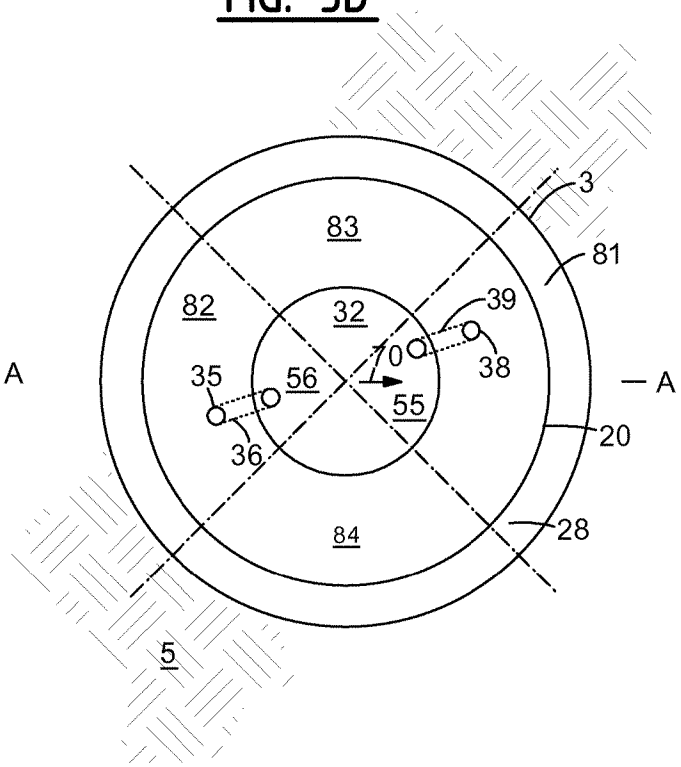
FIGS. 3A and 3B show plan views of cross sections of the borehole of FIG. 1, at different moments in time.
Figure 3A:
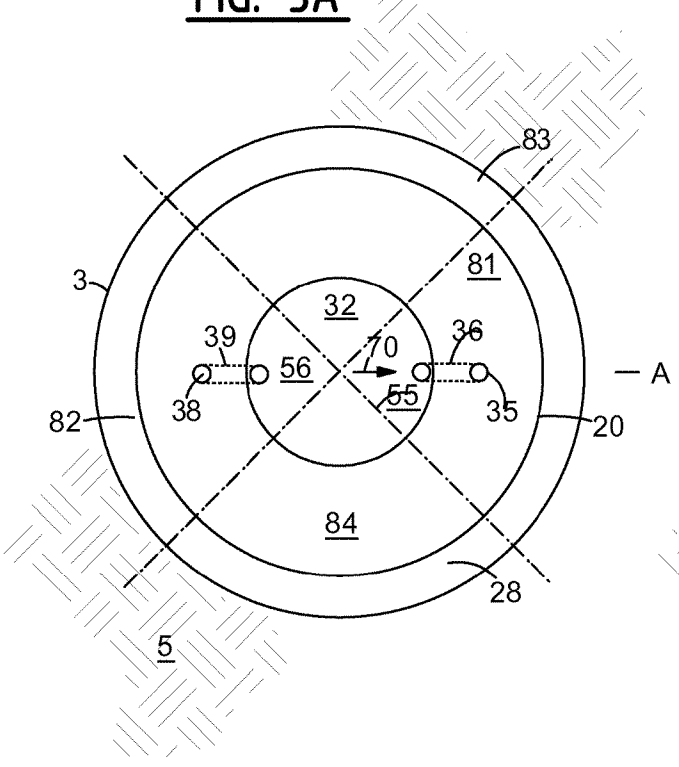

FIGS. 3A and 3B show schematic views down the borehole 3 in FIG. 1 are shown, for two different moments in time. FIGS. 3A and 3B show four sectors of the borehole bottom 28, including first sector 81 and second sector 82, separated by third sector 83 and fourth sector 84.

At the first moment in time (FIG. 3A), a first nozzle 35 with first inlet channel 36 is located in first angular sector 81 of the borehole bottom near point A in the formation 5. For clarity, the direction of flow diversion 70 is shown instead of the flow diverter 45 itself. The fluid flow is diverted towards area 55, from which the first inlet channel 36 extends at this moment in time. The second nozzle 38 is located in second angular sector 82 opposite sector 81 of the borehole bottom and receives fluid from the second area 56 of the intermediate space, which is outside of the area to which fluid flow is directed.

FIG. 3B shows a later moment in time, when the drill bit has turned so that the second nozzle 38 with inlet channel 39 is in the first sector 81 near point A, and receives fluid from the area 55 of the intermediate space 32 that is considered to be geostationary. The first nozzle 35 now is in the second sector 82 and receives fluid from the second area 56. Modulating the flow to nozzles such that a nozzle fluid flow parameter in the first sector 81 is relatively increased compared to the second sector 82 results in a different drilling progression in the two sectors and therefore to a directional drilling effect. As will be shown in the examples, the effect can have a different sign, dependent on, for instance, the type of drill bit used, so that the borehole can deviate towards point A or away from point A. The sign of the effect can be determined in advance.

The angular sectors 81, 82, 83, 84 are shown in FIGS. 3A, 3B as quadrants of the borehole bottom 28. The first and second sectors form opposite quadrants. The first and second sectors can be chosen differently; they can for example be opposite half circles, or can be two mutually exclusive sectors of different size (angle), together forming a full circle.

For an intermediate space having circular cross-sections, the first and second areas can be analogously defined, with respect to such circular cross-section instead of the borehole bottom.

FIG. 4 shows a further embodiment of a method and system 101 for directional drilling a borehole 3 in an earth formation 5 in accordance with the invention. Components that are substantially the same or similar to that of the embodiment of FIG. 1 are given the same reference numerals and reference is made to their description hereinabove. By way of difference with FIG. 1, the drill bit 110 is a roller-cone drill bit having three roller cones of which only two are shown with reference numerals 111,112. Roller cone 112 and its supporting leg are dashed, to indicate that this cone is behind the paper plane. The third roller cone (not shown) would be generally in front of roller cone 112. Each of the roller cones has an associated nozzle. First nozzle 35 with first roller cone 111, second nozzle 38 with second roller cone 112, and a third nozzle with the third roller cone (not shown). The nozzles communicate via inlet channels with the intermediate space 32 of the bit 110. A flow guide 133 is arranged in the intermediate space 32. The flow guide 133 in this embodiment may comprise an insert that can be placed in a conventional roller-cone bit, and is arranged such that it is rotatably locked, i.e. it rotates with the drill bit 110. The flow guide 133 comprises a first channel 134 co-operating at a downstream end 135 with the inlet to the first inlet channel 36, and a second channel 137 co-operating at its downstream end 138 with second inlet channel 39.

FIG. 5 shows a cross-sectional view of the flow guide 133, indicating a third channel 141 communicating with the third nozzle.

The flow directing means 42 of this embodiment comprises an outlet member 145 which, different from the outlet member 45 in FIG. 1, does not extend into the intermediate space 32 of drill bit 110. Rather, it is arranged to deliver fluid towards the upstream end 142, 143 of one of the flow channels 134, 137 or 141 in turn, dependent on the relative rotational position of drill bit 110 and the outlet member 145.

Directional drilling is essentially similar as in the embodiment of FIG. 1.

FIG. 6 shows the result of a model calculation of drilling radius in dependence of a differential hole making (DHM) effect between two opposite sides at the borehole bottom. DHM can be defined as the difference, expressed in percent, between the rates of penetration at the opposite sides (diametrically opposite points). Calculations were performed for a 15.2 cm (6 inch) drill bit. FIG. 6 indicates that a very small differential hole making effect is sufficient to achieve a practically useful directional drilling effect. A differential hole making effect of, for instance, about 0.1% may be sufficient to obtain a radius in the order of only 150 m.

FIGS. 7A and 7B schematically show an alternative flow direction means, in the form of deflection means 101, in perspective view and in top view. The deflection means may replace the outlet member 45 and lip 45*a* in the embodiments discussed above. Deflection means 101 has an upstream end 103 for receiving fluid flowing along the drill string element, a downstream end 105 forming a non-axial outlet 106 for fluid, and a flow path 108 for fluid between the upstream and downstream ends. The direction of fluid flow is indicated by arrow 109. The deflection means is rotatable about the axis of the drill string element (not shown) in which it is arranged. The axis of the drill string element 18 coincides with the axis 110 of the deflection means 101. The deflection means 101 of this embodiment comprises a deflection member 112 forming an at least partly helical flow channel 113 for fluid, coinciding with the flow 108 path. The flow path is arranged such that fluid flowing from the upstream end to the downstream end exerts a torque about the axis 110. The torque is indicated by force vector 115 which does not cross the axis 110.

FIGS. 8 to 10 show a rotational drilling system 201 for directional drilling of a borehole 3, which is arranged within an internal fluid passage 202 extending along the length of the drill string 16. The system 201 comprises a first or downhole bearing 204 and a second or upper bearing 206. The first and/or second bearing may be releasably coupled to the inner surface of the drill string 16. Said releasable coupling of the bearings may for instance include a landing nipple provided on said inner drill string surface and a matching profile on an outer surface of said bearings. Alternatively, the system may be releasably arranged within the bearings. In use, the bearings 204, 206 are connected to and will rotate in conjunction with the drill string 16.

In a preferred embodiment, the system 201 comprises a first rotatable section 210 and a second rotatable section 212. The first rotatable section 210 is able to rotate within the bearings 204, 206 and thus with respect to the drill string 16. Thus, the first rotatable section 210 is rotatably decoupled from rotation of the drill string. The second rotatable section 212 is able to rotate around the first rotatable section. The second rotatable section thus can rotate with respect to the drill string and to the first rotatable section 210. The first bearing 204 and the second bearing 206 are provided with fluid openings 205, 207 respectively (FIG. 9A) to allow passage of drilling fluid.

The first rotatable section 210 may comprise a first rotor 214. The first rotor is for instance provided with a number of first blades 216 (FIG. 9B). The first blades 216 are arranged at a first angle φ1 with respect to the drill string axis 18 to provide a first torque to the first rotor 214 upon passage of drilling fluid. The first torque may cause the first rotor to rotate along the drill string axis in a first direction, for instance counter-clockwise.

The first rotor 214 of the first rotatable section 210 is connected to a longitudinal shaft 218. Said shaft 248 is connected to a cylindrical part 220. The cylindrical part 220 is connected to shaft 48 extending through and rotatably arranged within the bearing 204. A downhole end of the shaft 48 is provided with the flow diverter 45. All the parts of the first rotatable section 210 will rotate in conjunction.

The second rotatable section 212 may comprise a second rotor 230 which is rotatably arranged enclosing the shaft 218. The second rotor 230 may be provided with a number of second blades 232. The second blades 232 are arranged at an average second angle φ2 with respect to the drill string axis 18 to provide a second torque to the second rotor 230 upon passage of drilling fluid 49. The second torque may cause the second rotor to rotate along the drill string axis in a second direction opposite to the first direction, for instance clockwise.

The second rotor section 212 can rotate at a continuously variable speed with respect to the first rotor section 210. The system includes suitable control means to control said speed.

As shown in FIGS. 9A and 9B, the second rotor 230 may be provided with at least one magnet 221. The magnet 221 may be a permanent magnet. Although not shown, each at least one magnet 221 may be arranged in one of the blades 232. The shaft 218 may comprise at least one corresponding magnet 222, preferably an electro magnet, i.e. an electrical coil.

Electrical wiring 223, extending via the shaft 218 and the first rotor 214, may connect the electro magnet 222 to at least one electro magnet 224. The magnet 224 is arranged near the interface between the first rotor part 214 and control unit section 225. The control unit section 225 may be provided with at least one corresponding electro magnet 226. Electrical wiring 227 connects the electro magnet 226 to control circuitry of the control unit 52 (see FIG. 1). Measured signals, control signals and electrical power can be transmitted inductively between the magnet 224 and the magnet 226.

In a preferred embodiment, shown in FIGS. 9C and 9D, the control unit 52 is integrated in the first rotor section 210. The control unit section 225 herein may be provided with additional measuring or control devices, such as a measuring-while-drilling (MWD) device 262. The MWD device may be a conventional survey device.

The control device being integrated in the first rotor section 210 minimizes delays in signal transfer and makes the system more stable and robust. As rotation of the first rotor section 210 is decoupled from rotation of the drill string 16, the directional drilling system of the invention is also decoupled from stick-slip phenomena and other rotational vibrations during drilling.

Herein, the control unit 52 for the system of the invention may comprise at least one orientation sensor for sensing the orientation thereof with respect to the formation. The at least one orientation sensor may comprise a magnetic sensor for sensing the earth magnetic field, a gravitational sensor, and/or a giroscope. The sensors are preferably tri-axial, i.e. able to measure in three dimensions in space. The orientation sensors may measure the inclination of the borehole with respect to respectively the gravitational field or the magnetic field of the earth. The data provided by each sensor may be used in combination, to improve accuracy of the data.

Also the MWD device 262 may be provided with orientation sensors, thus providing redundancy. The MWD device will generally be provided to comply with oil field requirements. However, the orientation sensors thereof may also provide data to the control unit 52, via the inductive coupling of coils 224, 226.

In a practical embodiment, the shaft 218 connected to the first rotor comprises about five to ten electrical coils, for instance about nine electrical coils, i.e. electro magnets. The second rotor 230 comprises about two to fifteen permanent magnets, for instance about three to five magnets. Optionally, each blade 232 may be provided with a separate magnet 221. Each magnet 221 is oriented in opposite direction, i.e. having the north pole and south pole inverted, with respect to adjacent magnets.

FIG. 11 shows a zoomed-out overview of an embodiment of the drilling system 201 of the invention, indicating relative sizes. FIG. 11 shows the drill bit 10 and a downhole end of the drill string 16. The directional drilling system 201 is arranged within the drill string. The boxes marked A to E refer to corresponding more detailed drawings 12A to 12E respectively.

FIG. 12A shows the drill bit 10. The drill bit may be a conventional drill bit as available from a multitude of vendors. A fluid directing insert 240 provided with fluid passage 242 is arranged within an internal drill fluid passage of the drill bit. The downhole end section of the drill string 16 may be provided with various housing sections 244, 246 enclosing the directional drilling system 201 of the invention. Said sections may be interconnected by threaded connections 248. Section 244 may be referred to as bearing tube. Section 246 may be referred to as top section. First bearing 204 and second bearing 206 are provided. The bearings decouple rotation of parts of the system 201 from rotation of the drill string. The system 201 may comprise any number of additional bearings to optimize said decoupling of rotation. Third bearing 250 is for instance indicated.

The top section 246 is provided with a cylindrical rotor house 252. First rotor 216 and second rotor 232 are arranged within said rotor house. Downstream of the rotors 216, 232, the system may be provided with a turbine section 254. One or more shock absorbers 256, 258 for damping shocks may be included. The shock absorbers may comprise rubber.

Upstream of the rotors 216, 232, the system may be provided with a first filter part 260. The filter part may filter and transfer electrical signals between the rotor components described above and a measuring while drilling (MWD) device 262. The MWD device may comprise a numbers of centralizers 264 to centralize the device within the drill string 16. The MWD device is part of the control unit 52, and is included in the control unit section 225 of the directional drilling tool 201.

The MWD device 262 may provide evaluation of physical properties, usually including pressure, temperature and borehole trajectory in three-dimensional space, while extending the borehole 3. The measurements are made downhole, may be stored in solid-state memory (not shown) for some time and later transmitted to the surface or to other sections of the directional drilling tool of the invention. Various data transmission methods may be used. Data transmission may typically involve digitally encoding data and transmitting to the surface as pressure pulses in the mud system. These pressures may be positive, negative or continuous sine waves. The MWD tool may have the ability to store the measurements for later retrieval with wireline or when the tool is tripped out of the hole if the data transmission link fails. However, data transmission to the rotor section 252 of the directional drilling tool may preferably involve electric signals. The electrical signals may be transmitted across rotating barriers by inductive coupling. For instance, signals may be transmitted between the control unit section 225 and the first rotor section 214 via electrical coils 226 and 224 respectively, by inductive magnetic coupling.

Figure 12B:
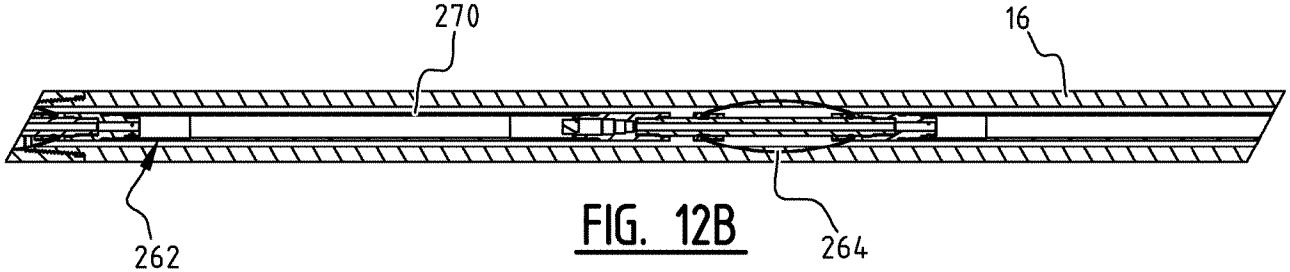
Figure 12C:
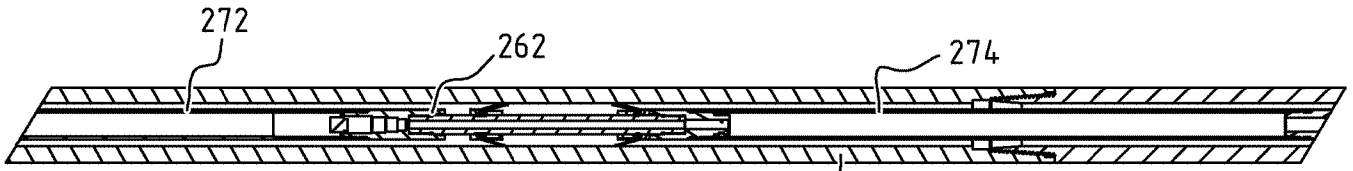
Figure 12D:
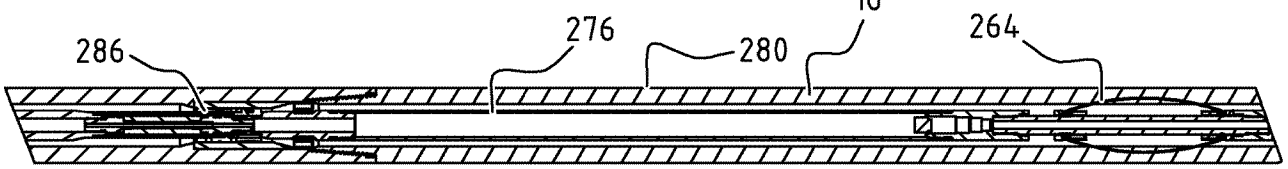
Figure 12E:
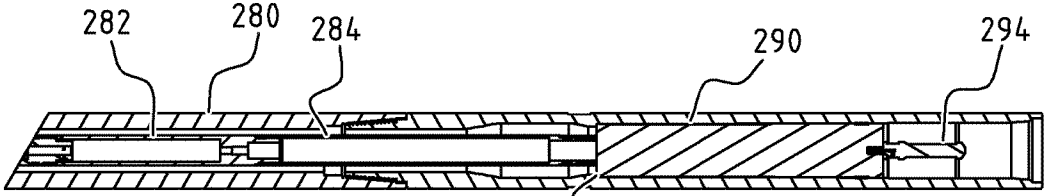

As shown in FIG. 12B, the MWD device 262 may comprise at least one tubular body. For instance first tubular body 270, second tubular body 272, third tubular 274, and fourth tubular body 276. The third tubular 274 and the fourth tubular body 276 may constitute an electronic pipe.

The control unit section 252 may comprise a second MWD device 280. The second MWD device may comprise fifth tubular body 282 and sixth tubular body 284. The second MWD device provides redundancy with respect to the first MWD device 262. In addition, data provided by the first and second MWD devices 262 and 280 may be compared and averaged by the control unit 52 (FIG. 1), to provide more accurate measurements.

A turbine 286 may be included. The turbine 286 can be driven by passing drilling fluid. The turbine can generate electrical power to one or both of the first and second MWD devices 262 and 280.

A top section 290 of the MWD device may engage a shoulder 292 on the inner surface of the drill string. The upper end of said top section may be provided with a fishing hook 294. The fishing hook enables the placement, removal and replacement of the directional drilling tool 201 of the invention, for instance by wireline. The tool 201 of the invention obviates tripping the entire drill string and allows to replace only the tool within the drill string, which is significantly faster. Replacing the tool 201 herein may imply replacing the entire tool, including the first rotor 214, the second rotor 230 and the respective first and second impellers 216, 232. Also the insert 240 may be introduced in the drill string, replaced or removed from the drill string by wireline.

The tool 201 of the invention may include a flow diverter 45 for directing a flow of drilling fluid 49 in a predetermined direction. However, conventional drill bits may not provide sufficient room to house said flow diverter. Designing a new drill bit, especially constructed for the directional drilling tool, would however be relatively expensive.

FIG. 13 shows an example of a conventional PDC drill bit, as available from a variety of vendors. Due to competition between said vendors and the size of the market, the costs of these bits is relatively modest. The drill bit 10 may be connected to the drill string 16 by pin type threaded coupling 300, having an end section 302. The drill bit 10 is typically provided with an internal fluid passage 32, corresponding to the intermediate space shown in FIG. 1. The drill bit may be provided with any number of fluid nozzles. Typically however, the drill bit may comprise three fluid nozzles and corresponding first inlet channel 36, second inlet channel 39, and third inlet channel (not shown). When the drill bit 10 is connected to the drill string 16, the fluid passage 32 is connected to the fluid passage 202 of the drill string.

The insert 240 is inserted in the fluid passage 32 of the bit 10 (FIG. 14A). Various embodiments of the insert are conceivable. For instance, the insert may comprise a cylindrical body 310 provided with internal fluid passage 242. The downhole end 312 of the insert 240 is provided with an eccentric fluid opening 314. The fluid passage 242 will divert fluid flow towards said eccentric fluid opening. An upper end 316 of the insert is provided with a protruding flange 318. The flange 318 provides a shoulder 320 for engaging the top end 302 of the drill bit. The insert may be produced of, for instance, ceramic or similar material.

The insert 240 is connected to and rotates in conjunction with the first rotor section 214. In the drill bit, the eccentric opening 312 will divert the flow of drilling fluid flow away from the axis of the drill string, towards one fluid nozzle of the, for instance three, fluid nozzles of the drill bit. The insert functions as flow diverter, and obviates a separate flow diverter above the insert.

For directional drilling, the first rotor 214 and all parts connected to it, such as the shaft 218, section 220, and also the insert 240, will be kept geostationary. The opening 314 directs the flow of drilling fluid continuously in one direction of the borehole, thus creating an underpressure and creating a curve in the trajectory of the borehole. For drilling in a straight direction, the first rotor 214 and the insert 240 rotate together with the drill string, wherein the fluid flow out of the opening 314 flushes each side of the borehole.

In another embodiment, shown in FIGS. 15A and 15B, the insert 240 comprises cylindrical body 310, flange 318 and shoulder 320 for engaging the top end 302 of the drill bit. Above the flange 318, the body 310 is provided with a connector section 322 for connecting the body to a downhole end of the first rotor section 214. An eccentric fluid passage 324 extends along the entire length of the body 310, and is provided with an eccentric fluid inlet 326 at its top end and an eccentric fluid outlet 328 at its downhole end. The insert of FIG. 15B is adapted to rotate in conjunction with the first rotor section 214.

The insert of FIG. 15 can be produced in ceramic at relatively low cost. Due to the central connection, i.e. aligned with the axis 18, to the rotor section 214, the insert requires fewer parts and can be provided with robust and relatively simple bearings. The latter enables better control of the position of the insert, and thus the flow diverter which is included in this insert. The insert also simplifies retrieval of the insert due to the central connection.

FIG. 16A shows an insert 241, comprising cylindrical body 330, for instance a disc shaped flange, provided with a number of tubes 332, 334, 336. The number of tubes may correspond to the number of fluid nozzles of the drill bit, for instance three. Eccentriccally located ends 342, 344, 346 of the tubes are directed towards the fluid inlet channels 36, 39

(FIG. 1) of the respective nozzles of the drill bit. The tubes may be made of steel or similar material.

The insert 241 shown in FIG. 16A is adapted to be fixated in the drill bit, as shown in FIG. 16B. Herein, the ends 342, 344, 346 are preferably aligned with the corresponding inlet channels 36, 39 of the drill bit. The insert 241 requires only minor modification of the drill bit, and may therefore be inserted in the drill bit at the drilling site. The insert may be fixated for instance by filling the remaining space in the fluid passage 32 of the drill bit with a suitable material. The suitable material may comprise a hardening polymer composition 33, which after curing is able to withstand the elevated temperatures and vibrations during drilling. The polymer composition 33 may for instance be based on polyurethane or epoxy. The insert 241 of FIG. 16A will be combined with a separate flow diverter connected to the first rotor section 214. The flow diverter 45 will direct fluid flow towards one of the tubes of the insert 241, thus providing the ability to steer the bit by diverted fluid flow as described above with respect to the other inserts.

FIG. 17 shows an insert 240 which extends only partly into the fluid passage 32 of the drill bit 10. The insert has central fluid passage 350 which diverts fluid away from the axis 18 and ends in eccentric fluid opening 352. Due to inertia, relatively more drilling fluid will be directed towards the fluid inlet aligned with the eccentric opening than towards the other fluid inlets. Herein, the drill bit may have three fluid inlets 36, 39 and 354. The insert of FIG. 17 is adapted to rotate in conjunction with the first rotor section 214.

FIG. 18 shows an insert 240 having a cylindrical body 358 which extends only partly into the fluid passage 32 of the drill bit 10. The body has eccentric fluid passage 360 which diverts fluid away from the axis 18 and ends in eccentric fluid opening 362. Due to inertia, relatively more drilling fluid will be directed towards the fluid inlet aligned with the eccentric opening 362 than towards the other fluid inlets of the drill bit. Herein, the drill bit may have three fluid inlets 36, 39 and 354. The insert of FIG. 18 is adapted to rotate in conjunction with the first rotor section 214. FIG. 18 shows connection 322 connected to the shaft 48 of the first rotor section.

FIG. 19 shows an embodiment of a closed loop control diagram for use in the control unit 52. The control unit, using the closed loop electronic control system 400 shown in FIG. 19, may control the directional drilling system of the invention.

A driller may provide the control circuit with a setpoint value 402. Said setpoint value may comprise a direction and/or radius for a curved section of the borehole, or a command to drill a straight section. Alternatively, the setpoint value may comprise a desired direction with respect to the axis 18 and a steering factor, which includes an indication of the force the device should apply to drill in the set direction. For drilling a curved section, the setpoint includes roll angle $\theta_{set}$ of the flow diverter 45 with respect to the drill string axis. The setpoint may also include a set radius of the curved section.

Herein, the radius of the curved section can be adjusted within a range. The upper limit of said range, i.e. the smallest radius $R_{min}$, is determined by the flow of drilling fluid, in combination with the geo-stationary flow diverter continuously at the same roll angle. The radius of the curved section may be limited by time alternating of the roll angle of the flow diverter. This means that the flow diverter alternates a selected geo-stationary position during a first time period t1 and a rotation around the axis 18 during a second time period t2. The radius of the curved section can be varied between 0 (wherein t1=0) and $R_{min}$ (wherein t2=0) by setting appropriate values for t1 and t2. To obtain a curved section of the borehole having radius $2*R_{min}$ for instance, t1 may be about equal to t2. In practice, t1 and t2 may be varied in the range of about 0 to 10 seconds up to about 5 to 10 minutes or more.

The setpoint is provided to sum element 404. The measured roll angle $\theta_m$ is provided to another input of the sum element 404 via feedback loop 405 and subtracted from the setpoint value 402. The difference or error value ε is provided to PID controller 406. The PID controller provides a t/T value to PWM module 408. Herein, t represents time and T represents torque on the first rotor section 210. See also the description above. A corrective current I is provided to the magnetic coils 222 of the first rotor section. Upon being presented with the current I, the coils 222 magnetically couple with the magnets 221 of the second rotor section 212, represented by magnetic torque Tmag.

A second sum element 410 is presented with a calculated value of the magnetic torque Tmag on a first input. A second input is provided with a calculated value of the fluid torque Thydro, i.e. the torque on the first and/or second rotor section due to the fluid flow 49.

In addition, the control loop may comprise an integrating element 412, providing the rotation speed co as output. The rotation speed co herein may indicate the rotation speed of the first rotor section with respect to the formation, i.e. rotational speed $\omega_{2/0}$. Feedback gain 414 of feedback loop 416 may be set to automatically correct this value. Element 418 uses the rotational speed ω to calculate the roll angle of the first rotor element 210, and thus the flow diverter. Using the feedback loop 405, said roll angle is automatically corrected upon deviation from the setpoint value 402.

In the embodiment shown in FIGS. 9C and 9D, the control unit 52 including at least one orientation sensor may be arranged on the first rotor section 210. This enables an improved control loop. Herein, orientation data provided by the orientation sensors are directly used by the control loop. I.e., the control loop 400 may use a measured value for ω and/or θ, which can be controlled by the feedback loop and driven towards the setpoint value 402.

Some theory of the operation of the directional drilling tool of the invention will be provided below.

The objective is to provide a tool that is able to control the roll angle of the diverter with respect to the axis of the tool. Locally, said axis is aligned with the axis 18 of the drill string (FIG. 1), which is also referred to as the z-axis. The tool will not allow any translations. Neither will the tool allow for rotation around the x-axis and y-axis (both perpendicular to each other, and to the z-axis).

The design of the tool 201 satisfies the following criteria.

The tool is robust and able to operate in downhole conditions. The latter may include one or more of high temperature, high pressure, shocks, corrosion and contact to corrosive materials, sand and other particulate matter. The number of moving parts is therefore minimized.

The tool is retrievable through the drill string. All parts, including the impellers of the first and second rotors, are retrievable and are moveable through the fluid passage 202 (FIG. 8) of the drill string 16.

The control module and the control circuitry are relatively simple. This renders the control unit robust and extends the lifetime, especially in downhole conditions.

The second rotor section 230 is a generator-based design. A downhole generator for generating electrical power may be used to power the embedded electronics and tools and motors. The generator transforms part of the hydraulic power of the drilling fluid in electric power. The generation of electrical power will therefore also involve a pressure drop across the generator.

Conventionally, the stator of the generator (corresponding to the shaft 218 in the tool of the invention) is held in the drill string and rotates at the same speed as the drill string (e.g. typically the drill collar section thereof). According to the present invention, the generator is transformed in a stabilizer. Herein, the stator of the generator (the first rotor section 214 in the present tool) is decoupled from the rotation of the drill string by adding at least two bearings, one above the generator and one below. Thus, both the stator and the rotor (i.e. the second rotor section 230) of the generator are free to rotate around the z-axis.

Basically, the design comprises two moving (rotating) parts. The generator body (the first rotor section 210) and the turbine (the second rotor section 212). These two parts are free to rotate around their common axis of revolution, i.e. the z-axis or drill string axis.

This provides a one dimensional problem. Translations and rotations around the x-axis and the y-axis are impossible. The tool has two degrees of freedom, i.e. the first roll angle of the first rotor 214 (also stator of the turbine) and the second roll angle of the second rotor 230 (the turbine).

The control circuitry of the control unit 52 controls the electric load. Thus, the electronics change the magnetic coupling between the fast spinning turbine 230 and the first rotor section 214. During directional drilling, the latter is kept geostationary. When drilling a straight section of the borehole, the first rotor section rotates at a speed comparable to the rotation of the drill string.

Basically, the directional drilling tool of the invention comprises three sections which can rotate with respect to each other:

1) Section 1: The drill string;
2) Section 2: The first rotor section 214. The first rotor section is connected to the fluid diverter 45. Also, the first rotor is connected to the shaft 218 which constitutes the stator of the generator. The first rotor section is equipped with impellers or blades to create a rotational torque in a first direction, for instance counter clock-wise torque. In an embodiment, the shaft 218 is provided with a set of nine electrical coils; and
3) Section 3: The turbine or second rotor 230. The second rotor is equipped with impellers or blades creating a torque in a direction opposite to the rotation of the first roto, for instance a clock-wise torque. The second rotor is provided with permanent magnets (See FIG. 9). The permanent magnets will induce an electrical current in the coils of the shaft 218 upon rotation with respect to each other.

The kinematics of the system with respect to the formation as a reference frame are determined by the roll angles $\theta_{2/1}$ and $\theta_{3/2}$. Herein, $\theta_{2/1}$ is the roll angle of section 1 with respect to section 2. $\theta_{3/2}$ is the roll angle of second 3 with respect to section 2. The roll angle indicates an angle of rotation around the z-axis, for instance when viewed in plan view in the direction towards the drill bit. Short-term averages of translations and rotational speeds around the x-axis and the y-axis of section 1 (i.e. the drill string) in the terrestrial reference frame (i.e. the formation 5) are substantially zero, and can be ignored.

In addition, the rotational speed $\omega_{1/0}$ (in [rad/s], [RPM] or in [Hz]) of section 1 (the drill string 16) with respect to the formation 5 (also referred to as section 0) is imposed to the system. During drilling, the rotational speed $\omega_{1/0}$ is substantially constant. Also defined is the flow Q (in [$m^3$/s]) of drilling fluid through the drill string.

In view of the above, to predict the behavior of the directional drilling system, an analysis of projection of torque on the z-axis is sufficient.

Various torques T applied on section 2 can be described as:

$$T_{1\to 2}=f_1(\omega_{2/1},Q) \tag{1}$$

$$T_{Fluid\to 2}=f_2(\omega_{2/0},Q) \tag{2}$$

$$T_{3\to 2}=T_{3\to 2(friction)}+T_{3\to 2(magnetic)} \tag{3}$$

$$T_{3\to 2(friction)}=f_3(\omega_{2/3},Q,\text{inclination}) \tag{4}$$

$$T_{3\to 2(magnetic)}=M(\omega_{2/3},\alpha) \tag{5}$$

Herein, $T_{1\to 2}$ is the torque applied by section 1 to section 2, and $f_1$ indicates a first function which is dependent on variables $\omega_{2/1}$ and Q. $T_{Fluid\to 2}$ is the torque applied by the fluid flow to section 2, and $f_2$ indicates friction coupling for section 2, which is dependent on variables $\omega_{2/0}$ (the rotational speed of section 2 with respect to section 0, i.e the formation) and Q. $T_{3\to 2}$ is the torque applied by section 3 to section 2, which is a combination of $T_{3\to 2(friction)}$ and $T_{3\to 2(magnetic)}$. $\alpha$ represents the accuracy of accelerometers of the positioning sensor of the control unit 52.

Herein, $T_{3\to 2(friction)}$ is the torque applied by section 3 to section 2 due to friction, and $T_{3\to 2(magnetic)}$ is the torque applied by section 3 to section 2 due to magnetic coupling. $T_{3\to 2(friction)}$ depends on $f_3$, which is the friction coupling of section 3. Friction coupling $f_3$, depends on variables $\omega_{2/3}$. Q, and Inc. $T_{3\to 2(magnetic)}$ depends on the magnetic coupling between section 2 and section 3. Said magnetic coupling M depends on variables $\omega_{2/3}$ and $\theta_{3/2}$ (which is the roll angle of section 3 with respect to section 2).

Various torques applied on section 3 can be described as:

$$T_{2\to 3}=-T_{3\to 2} \tag{6}$$

$$T_{Fluid\to 3}=f_3(\omega_{3/0},Q) \tag{7}$$

Herein, $T_{2\to 3}$ is the torque applied by section 2 to section 3. Said torque $T_{2\to 3}$ is negatively proportional to the torque $T_{3\to 2}$ applied by section 3 to section 2. $T_{Fluid\to 3}$ is the torque applied by the flow of drilling fluid to section 3. The torque $T_{Fluid\to 3}$ depends on $f_3$, which is a function of variables $\omega_{3/0}$ (rotational speed of section 3 with respect to the formation) and Q.

In addition, $J_2$ is defined as the moment of inertia of section 2. $J_3$ is defined as the moment of inertia of section 3. Both $J_2$ and $J_3$ relate to inertia around their common axis of revolution, which is the z-axis and locally coincides with the axis 18 of the drill string. The physical law of motion gives:

$$\frac{d\omega_{1/0}}{dt}\approx 0 \tag{8}$$

$$J_2\frac{d\omega_{2/0}}{dt}=T_{1\to 2}+T_{Fluid\to 2}+T_{3\to 2} \tag{9}$$

$$J_3\frac{d\omega_{3/0}}{dt}=T_{2\to 3}+T_{Fluid\to 3} \tag{10}$$

$$\theta(t)=\int_0^t \omega_{2/0}\,dt+\theta(0) \tag{11}$$

Given the formulas above, by determining the following parameters it will be possible to predict the evolution of the parts of the directional drilling system of the invention and to control it:

Moments of inertia $J_2$, $J_3$;

Friction couplings $f_1$, $f_2$, $f_3$;

Turbine torques $T_2$, $T_3$;

Magnetic coupling M.

The magnetic coupling behavior of the generator (i.e. the assembly of section 2 and section 3) is controlled by the relation between rotational speed of the turbine (i.e. section 3, which is the second rotor 230), torque between section 2 and section 3 due to magnetic coupling, current generated and voltage across an output of a rectifier. When rotating with respect to the first rotor, the magnets 221 of the second rotor 230 induce an alternating electrical current (AC) in the coils 222 of the first rotor. The first rotor section 230 may be provided with a rectifier to transfer the alternating current in a direct current (DC).

Tests of the drilling system of the invention have indicated that the magnetic torque between section 2 and section 3 varies linearly with the current generated in the electrical coils 222. And within certain boundaries, said current can be controlled by the control unit 52. For instance, the control unit 52 can draw an adjustable amount of electrical power, and thus control the current, for powering electrical equipment. Alternatively, the control unit may be provided with an adjustable resistor connected to the coils 222 to adjust the current.

It is not required to further analyse the movement of the second rotor 230 around the shaft 218 of the first rotor 214. The rotational speed $\omega_{2/3}$ is only required to determine the maximum current that can be generated by relative rotation of the second rotor 230 with respect to the shaft 218.

In a practical embodiment, the proportional coefficient between torque and current may be in the order of 0.05 to 0.3 Nm/A, for instance about 0.14 Nm/A.

A range of torque between sections 2 and 3 made available by the design of the present invention may be in the order of 0.3 to 0.8 Nm.

The rotational speed $\omega_{1/0}$ may be in the range of 40 to 80 RPM, for instance about 60 RPM. The rotational speed $\omega_{2/1}$ will be about equal but opposite to the rotational speed $\omega_{1/0}$ during drilling of a curved section, and may be about 0 during drilling of the straight section. The rotational speed $\omega_{3/2}$ may be in the range of 500 to 4000 RPM, for instance about 1000 RPM.

The control unit 52 may be equipped with one or more orientation sensors. The sensor may be selected from a 3-axis accelerometer and a 3-axis magnetometer. The control unit may in addition be provided with a gyroscope, which may further improve the performance and accuracy of the system. Herein below an exemplary description is provided of a method to provide a suitable value of the roll angle θ. In principle, roll angle herein implies the roll angle $\theta_2$ of the first rotor section 210. Other roll angle may however be calculated as well. Suitable herein implies the value is accurate within a predetermined tolerance and rapidly obtained. Rapid herein implies the value is obtained within a time period $t_\theta$ which is small with respect to the rotational speed of the drill string. The drill string typically rotates at about 60 RPM, which is about 1 rotation per second. $t_\theta$ is preferably smaller than 0.1 second, or rather smaller than 0.01 second.

The feedback variables can be written in vector notation:

$$y = \begin{pmatrix} Ax \\ Ay \\ Az \\ Hx \\ Hy \\ Hz \\ \omega \end{pmatrix} \tag{12}$$

θ has to be found as a function of y. Two different ways to find θ are: integration and linear algebra.

Integration of ω provides:

$$\theta = \theta_0 + \int_0^{tt} \omega(t)dt \tag{13}$$

The following co-ordinate systems may be defined. Careful consideration may be given to the formation. The formation may be expressed in earth coordinate system $B_1$, defined for example as:

1) $\vec{z}_1$ points downward, from surface into the borehole. Downward may be defined as the direction given by a plumb line or the local direction of the gravitational field $\vec{g}$. This direction may differ from the line connecting the respective drilling location with the centre of the earth, for instance due to rotation of the earth and anomalies in the gravitational field. The gravitational vector $\vec{g}$ may be supposed to be substantially uniform in the entire volume wherein the system will operate, i.e. the borehole.

2) $\vec{x}_1$ points towards the magnetic north. A compass may provide the direction. This is a projection of the magnetic field of the earth on a horizontal plane. The angle made by the magnetic field with the horizontal is defined as the magnetic DIP. In Europe, DIP may be about 70°, indicating that the horizontal component is about a third of the total magnetic field strength. It is also assumed that the magnetic field is substantially uniform in the entire volume of interest, i.e. the borehole.

3) $\vec{y}_1$ may be defined to create a right handed orthonormal basis. I.e. $\vec{y}_1$ is directed east.

A tool co-ordinate system $B_4$ is defined, which is attached to the bit. $B_4$ is defined as:

i) $\vec{z}_4$ is the axis of revolution of the bit; and ii) $\vec{x}_4$ and $\vec{y}_4$ are chosen such that $B_4$ is right handed orthonormal.

$B_2=(\vec{x}_2,\vec{y}_2,\vec{z}_2)$ and $B_3=(\vec{x}_3,\vec{y}_3,\vec{z}_3)$ are the successive bases to move from the terrestrial co-ordinate system $B_1$ to the tool co-ordinate system $B_4$. The diagrams shown in FIG. 20 describe the relative position of these bases to each other. Herein, Inc. indicates the inclination, and Az indicates a rotation.

Transfer matrices may be expressed as follows:

$$P_{B1}^{B2} = \begin{pmatrix} \cos Az & -\sin Az & 0 \\ \sin Az & \cos Az & 0 \\ 0 & 0 & 1 \end{pmatrix} \in SO_3(\Re) \tag{14}$$

$$P_{B2}^{B3} = \begin{pmatrix} 1 & 0 & 0 \\ 0 & \cos Inc & -\sin Inc0 \\ 0 & \sin Inc & \cos Inc \end{pmatrix} \in SO_3(\Re) \tag{15}$$

-continued $$P_{B3}^{B4} = \begin{pmatrix} \cos\theta & -\sin\theta & 0 \\ \sin\theta & \cos\theta & 0 \\ 0 & 0 & 1 \end{pmatrix} \in SO_3(\Re) \tag{16}$$

As the matrices (14), (15) and (16) are orthogonal, one may write:

$$(P_{B1}{}^{B2})^{-1} = {}_0^t(P_{B1}{}^{B2}) \tag{17}$$

R can be computed as:

$$\Re = {}_0^t(P_{B1}{}^{B2})\,{}_0^t(P_{B2}{}^{B3})\,{}_0^t(P_{B3}{}^{B4}) \tag{18}$$

Subsequently, three angles Az, Inc and DIP are defined. Below an exemplary method is provided to obtain these three angles. The definition of $\vec{z}_1$ gives $\vec{g}=g\vec{z}_1$. Then:

$$\begin{pmatrix} 0 \\ 0 \\ g \end{pmatrix} = P_{B_1}^{B_2} \cdot P_{B_2}^{B_5} \cdot P_{B_3}^{B_4} \begin{pmatrix} A_x \\ A_y \\ A_z \end{pmatrix} \tag{19}$$

Because of orthogonal matrix properties:

$$\begin{pmatrix} A_x \\ A_y \\ A_z \end{pmatrix} = {}^tP_{B_1}^{B_2} \cdot {}^tP_{B_2}^{B_5} \cdot {}^tP_{B_3}^{B_4} \begin{pmatrix} 0 \\ 0 \\ g \end{pmatrix} \tag{20}$$

Then:

$$\begin{pmatrix} A_x \\ A_y \\ A_z \end{pmatrix} = g \begin{pmatrix} \sin Inc \sin\theta \\ \sin Inc \cos\theta \\ \cos Inc \end{pmatrix} \tag{21}$$

and $$Inc = \operatorname{atan2}\left(\frac{\sqrt{A_x^2 + A_y^2}}{A_z}\right) \tag{22}$$

DIP is the angle between the horizontal plane and the magnetic field. Then π/2−DIP is the angle between the magnetic field and the gravity field (See FIG. 21). And because the scalar product is independent from the basis in which the vectors are expressed:

$$\cos\left(\frac{\pi}{2} - DIP\right) = \sin DIP = \frac{\vec{A} \cdot \vec{H}}{\|\vec{A}\|\|\vec{H}\|} \tag{23}$$

so that $$DIP = \arcsin\left(\frac{A_x H_x + A_y H_y + A_z H_z}{\sqrt{A_x^2 + A_y^2 + A_z^2}\sqrt{H_x^2 + H_y^2 + H_z^2}}\right) \tag{24}$$

The calculation of Az preferably does not involve θ, as Az may be required to determine θ. Herein, linear algebra may assist. We want the angle between the projection of the magnetic field on the horizontal plane and the projection of the drilling direction on the same plane. The magnetic field B is:

$$\vec{B} = \begin{pmatrix} H_x \\ H_y \\ H_z \end{pmatrix} \tag{25}$$

the drilling direction d is:

$$\vec{d} = \begin{pmatrix} 0 \\ 0 \\ 1 \end{pmatrix} \tag{26}$$

and $$\begin{pmatrix} A_x \\ A_y \\ A_z \end{pmatrix}$$

is a normal vector of the horizontal plane P.

We define $$\vec{S} = \begin{pmatrix} H_x \\ H_y \\ H_z \end{pmatrix} \wedge \begin{pmatrix} A_x \\ A_y \\ A_z \end{pmatrix} = \begin{pmatrix} H_y A_z - H_z A_y \\ H_z A_x - H_x A_z \\ H_x A_y - H_y A_x \end{pmatrix}$$

and $$\vec{T} = \begin{pmatrix} 0 \\ 0 \\ 1 \end{pmatrix} \wedge \begin{pmatrix} A_x \\ A_y \\ A_z \end{pmatrix} = \begin{pmatrix} -A_y \\ A_x \\ 0 \end{pmatrix}.$$

Herein, S makes an angle of +π/2 with the projection of the magnetic field on P. T makes an angle of +π/2 with the projection of the drilling direction on P. Then:

$$Az = \operatorname{angle}(\vec{S}, \vec{T}) \tag{27}$$

Herein, $\vec{S}$ is null if the magnetic and the gravity fields are co-linear. $\vec{T}$ is null if the drilling is vertical. In both cases, Az may have to be defined with other means.

$$Az = \operatorname{sign}(Az)\arccos\left(\frac{-A_y(H_y A_z - H_z A_y) + A_x(H_z A_x - H_x A_z)}{\sqrt{A_x^2 + A_y^2}\sqrt{(H_y A_z - H_z A_y)^2 + (H_z A_x - H_x A_z)^2 + (H_x A_y - H_y A_x)^2}}\right)$$

The angle Az is defined positive in counter clockwise direction to be coherent with the previous notations. It may not be defined if Inc=0, and other sensors may be required to provide data the closer Inc is to 0.

The drilling direction is changing very slowly compared to rotation around the axis of the tool. The DIP angle can be regarded as constant over time and space if the magnetic field and the gravity field are assumed to be uniform.

At least one, for instance three low-pass filters with relatively low cut-off frequencies may be added to the outputs to obtain Az, Inc and DIP. $\overline{Az}$ is defined as the estimated Azimuth. It may be expressed as:

$$\vec{Az} + K\frac{d\vec{Az}}{dt} = Az_{det} \tag{28}$$

Two exemplary methods to find θ are provided below. These methods may be used separately or in combination.

1) Using signals from the accelerometer. The definition of $\vec{z_1}$ gives $\vec{g}=g\vec{z_1}$. Then:

$$\begin{pmatrix} 0 \\ 0 \\ g \end{pmatrix} = P_{B_1}^{B_2} \cdot P_{B_2}^{B_5} \cdot P_{B_3}^{B_4} \begin{pmatrix} A_x \\ A_y \\ A_z \end{pmatrix} \tag{29}$$

Because of orthogonal matrix properties:

$$\begin{pmatrix} A_x \\ A_y \\ A_z \end{pmatrix} = {}^tP_{B_1}^{B_2} \cdot {}^tP_{B_2}^{B_3} \cdot {}^tP_{B_3}^{B_4} \begin{pmatrix} 0 \\ 0 \\ g \end{pmatrix} \tag{30}$$

Then:

$$\begin{pmatrix} A_x \\ A_y \\ A_z \end{pmatrix} = g \begin{pmatrix} \sin Inc \sin\theta \\ \sin Inc \cos\theta \\ \cos Inc \end{pmatrix} \tag{31}$$

$$\theta_{acc} = \operatorname{atan2}\left(\frac{A_x}{A_y}\right) \tag{32}$$

This formula is most suitable for Inc≠0. The closer Inc is to 0, the more the signals provided by other available sensors will be used to improve accuracy.

2) Using signals from the magnetometer. With dimensionless notations, the magnetic field is:

$$\cos DIP\vec{x_1} + \sin DIP\vec{z_1} \tag{33}$$

$$\begin{pmatrix} \cos DIP \\ 0 \\ \sin DIP \end{pmatrix} = P_{B_1}^{B_2} \cdot P_{B_2}^{B_3} \cdot P_{B_3}^{B_4} \begin{pmatrix} H_x \\ H_y \\ H_z \end{pmatrix} \tag{34}$$

Then, $$\begin{pmatrix} H_x \\ H_y \\ H_z \end{pmatrix} = \cos DIP \begin{pmatrix} \cos Az \cos\theta - \sin Az \sin\theta \cos Inc \\ -\cos Az \sin\theta - \sin Az \cos\theta \cos Inc \\ \sin Az \sin Inc \end{pmatrix} + \sin DIP \begin{pmatrix} \sin\theta \sin Inc \\ \cos\theta \sin Inc \\ \cos Inc \end{pmatrix} \tag{35}$$

The first two lines give $$A\begin{pmatrix} \cos\theta \\ \sin\theta \end{pmatrix} = \begin{pmatrix} H_x \\ H_y \end{pmatrix}.$$

Positions for which detA=0 may be defined from $$\det A = -\cos^2 DIP \cos^2 Az - (\cos DIP \sin Az \cos Inc - \sin DIP \sin Inc)^2 \tag{35}$$

$$\det A = 0 \Rightarrow \begin{cases} \cos DIP \cos Az = 0 \\ \cos DIP \sin Az \cos Inc - \sin DIP \sin Inc = 0 \end{cases} \tag{36}$$

Assuming DIP≠0, cosAz=0⇒ sin Az=±1. Then cos (DIP±Inc)=0 i.e.

$$Inc = \pm\frac{\pi}{2} \pm DIP.$$

In fact, some of these positions are equals. There are only two different positions that are $$(Az, Inc) = \left(\frac{\pi}{2}, \pm\frac{\pi}{2} - DIP\right) \tag{37}$$

This result means that the singular positions are those where $\vec{z_4}$ has the same direction than the magnetic field (and hence two opposite directions).

$$\theta_{mag} = \operatorname{atan2}\left(\frac{(\cos DIP \sin Az \cos Inc - \sin DIP \sin Inc)H_x + (\cos DIP \cos Az)H_y}{(-\cos DIP \cos Az)H_x + (\cos DIP \sin Az \cos Inc - \sin DIP \sin Inc)H_y}\right) \tag{38}$$

This formula is applicable if $$(Az, Inc) \neq \left(\frac{\pi}{2}, \pm\frac{\pi}{2} - DIP\right).$$

For positions wherein (Az, Inc) is close to, or equal to these singular positions, another method for determining θ will be preferred to improve accuracy.

If Inc=0, there are only two rotations around the same axis $\vec{z_1}$ and then $(\vec{x_1},\vec{x_4})$=Az+θ. It is possible to then define $$\begin{cases} \theta' = \theta + Az \\ Az' = 0 \end{cases}$$

in a region where Inc<3°.

Accelerometers are typically more accurate than magnetometers. therefore, the first method will be preferred over the second. However, for some singular positions mentioned above, another type of orientation sensor will be used to provide control signals.

As shown in FIG. 21, it may be possible to define two uncertainty cones comprising the directions of $\vec{z_4}$ for which $\theta_{mag}$ and $\theta_{acc}$ may be less accurate. The top angles of the two cones are defined by an error margin as set by an operator.

If $\vec{z_4}$ is in the cone with the $\vec{g}$ axis of revolution i then the operator may prefer to use the magnetometers to determine θ.

If $\vec{z_4}$ is in the cone with the $\vec{B}$ axis of revolution then the operator may prefer use the accelerometers to determine θ.

In order to have always at least one detector available, it is preferred to avoid intersection of the two cones. If DIP<60° then it will be possible to choose large top angles, and related small error margins. On the contrary, if DIP>80°, then it may be necessary to find a compromise.

The compromise can be obtained by merging information from both the magnetometers and the accelerometers using a weighting function. This may not be possible at locations on the globe where the angles between $\vec{g}$, $\vec{B}$ and $\vec{z_4}$ are below a predetermined threshold. At those locations, other sensors may be required to provide the data.

The measured roll $\theta_{mes}$ is defined as:

$$\theta_{mes}=t(Inc,Az)\theta_{acc}+(1-t(Inc,Az))\theta_{mag}t\in[0,1] \tag{39}$$

We can use this simple expression for t. More complex solutions are also still eligible:

$$t=\begin{cases}1 & \text{if } Az>\alpha\\ 0 & \text{else}\end{cases} \tag{40}$$

Herein, $\alpha$ is defined by the accuracy of the accelerometers. In practise, this value may be set at about $\alpha=3°$.

The expression is usable only if the angle between magnetic field and gravity field is not too small. In this case, the algorithm will automatically switch to the output of the magnetometer when the drilling inclination is less than 3°. However, the drilling direction would also be in the uncertainty cone of the magnetometers.

Please note that the 3° top angle of the uncertainty cones enables accurate directional drilling using the system of the invention. If the drilling rig is located in an area of the world where the uncertainty cones of the gravity field and the magnetic field overlap, it is still possible to use:

$$t=\begin{cases}1 & \text{if } Az>\dfrac{\frac{\pi}{2}-DIP}{2}\\ 0 & \text{else}\end{cases} \tag{41}$$

Accelerometers give accurate values of the roll angle if the system is stabilised. In general, the system is stabilized due to the decoupling of the rotation from rotation of the drill string due to the bearings 204, 206.

As an additional measure however, it will be possible to correct the data provided by the orientation sensors if the first rotor section 210 containing the accelerometers begins to turn around its roll axis. In this case it will for instance be possible to use a gyroscope.

For further improved accuracy, it is possible to implement a Kalman filter that fuses the signals provided by the accelerometer, magnetometer and gyroscope. For instance:

$$\frac{d\theta}{dt}=\omega_{gyro} \tag{42}$$

and $$\theta=\theta_{det}$$

The estimated value may be defined as:

$$\frac{d}{dt}\hat{\theta}=\omega_{gyro}+K(\hat{\theta}-\theta_{det}) \tag{43}$$

Herein, $\hat{\theta}$ converges towards $\theta_{det}$. With the error described as $\tilde{\theta}=\hat{\theta}-\theta_{det}$:

$$\frac{d\tilde{\theta}}{dt}=K\tilde{\theta} \tag{44}$$

Then, $\tilde{\theta}\rightarrow 0$ if K<0. The larger the value |K|, the closer the estimated roll angle will be to the measured roll. The smaller it is, the longer it will take before the estimated value is within a preset range with respect to the measured roll. An optimal value for K may be determined by experiments.

The purpose of the present invention is to provide a device that controls the direction of fluid flow through a drill bit while a drill string is rotating.

This is achieved by attaching a flow diverter device to a platform suspended in a set of bearings such that the platform is free to rotate about the axis of the drill string. The platform to which the flow diverter is connected has position sensors fixed to it such that the sensors can measure the rotational position of the flow diverter.

The assembly uses two rotors 214, 230, each provided with blades 216, 232 respectively (FIG. 9). The assembly controls the rotational position of the platform and the flow diverter.

During drilling, the drill string 16 is rotating at a set rotational speed. Said speed is set at surface, for instance as input to a drive system, typically a top drive or rotary table. To steer the borehole, the system will control the direction of fluid flow through the drill bit.

The drilling fluid flows through the central fluid passage 202 of the drill string 16. This flow hits the first impeller 216 that is connected directly to the platform and the flow diverter. The blades of the impeller 216 may be designed to rotate the platform, for instance counter clockwise. Without any control loop, the blades of the first impeller 216 would cause the platform and the flow diverter 45 to continuously rotate in a counter clockwise direction.

The fluid flow then engages the second turbine blades 232. The second turbine blades 232 rotate in a direction opposite to the direction of the platform blades, for instance in clockwise direction. Without any control loop the second impeller 232 would rotate clockwise at a speed substantially higher than the first impeller 216.

The blades of the second impeller 232 may be provided with magnets 221, for instance embedded into the blades. The magnets may transmit torque to coils arranged in the blades of the first impeller 216, and consequently to the platform, due to magnetic coupling. The amount of torque that is coupled between the respective first impeller and second impeller can be controlled by controlling the electrical load on the winding side of the magnetic coupling.

Since the torque between the blades of the two impellers can be controlled, and as the respective impellers 216, 232 rotate in opposite directions, the speed and position of the turbine blades connected to the platform, and thus to the flow diverter, can be controlled. Hence, the orientation of the flow diverter 45 can be controlled. The output of rotational position sensors connected to the platform, i.e. to the first rotor section 214, is used in a feedback loop to modulate the electrical load provided to the coils 222. The feedback loop thus controls the magnetic coupling torque $T_{3\rightarrow 2(magnetic)}$ which drives the platform to the desired position.

Experiments have proved that the embodiments as described above can provide a geo-stationary platform to hold the flow diverter. The range of friction torque from the bearings holding the first rotor section 210 and/or from hydraulic perturbations may be in to range of 0.1 Nm to 0.36 Nm. The angles φ1 and φ2 of the first and second blades respectively may be selected such that the flow diverter can be held geostationary when the flow of drilling fluid exceeds a preselected threshold, for instance 450 liter/min. A pressure drop across the directional drilling tool of the invention may be in the order of 10 to 25 psi (69 to 172 kPa) for the selected fluid flow.

The angle φ1 of the first blades may be in the range of 10 to 35 degrees. The angle φ2 of the second blades may be in the range of 15 to 45 degrees. In a preferred embodiment, φ2 exceeds φ1 to ensure that the second rotor section 212 rotates faster than the first rotor section 210.

The insert of the invention enables to convert a conventional rotary drill bit into a rotary steerable bit for a rotational directional drilling system as described above. The insert may be rotatable and connected to a geostationary platform. Alternatively, the insert may be fixated in the drill bit. The insert is suitable to be introduced in the drill bit at a drilling location, including remote locations and off-shore rigs. The insert of the invention allows to use readily available conventional rotary drill bits in combination with a highly sophisticated albeit relatively cost efficient rotary drilling method as described above.

EXAMPLES

Experiments were conducted in lab drilling tests. A 15.2 cm drill bit of either PDC or tricone type was used to drill into various rocks. The rate of penetration (ROP) was measured for varying "hydraulic horsepower per square inch" (HSI) of fluid flow through all nozzles. This parameter is used in the art, and corresponds to the pressure drop over the nozzle Δp times the flow rate Q, divided by the nozzle cross-sectional area A. The conversion to SI units is 1 HSI=0,1140 kW/cm$^2$. Water was used as drilling fluid.

Example 1

A 6" (15.2 cm) PDC bit was used to drill at 60 rotations per minute (RPM) and 2 ton (2000 kg) weight on bit (WOB) in sandstone, at a downhole pressure of 10 MPa. The ROP measured as a function of the HSI is given in Table 1.

TABLE 1

| HSI (kW/cm$^2$) | ROP (m/hr) |
|---|---|
| 0.2 (0.023) | 16.3 |
| 0.6 (0.068) | 17.5 |
| 1.4 (0.16) | 18.0 |
| 2.7 (0.31) | 18.7 |

The experiments show that the rate of penetration is uniquely related to nozzle fluid flow; ROP increases with increasing nozzle fluid flow. In the course of the experiments it was observed that the effect is instantaneous, i.e. within a single rotation of the drill bit. Therefore, providing higher fluid flow (corresponding to higher HSI) to nozzles in a first sector of the borehole bottom, as compared to nozzles in a second sector, provides a differential ROP and leads to a directional drilling effect.

Example 2

A 6" (15.2 cm) tricone bit was used to drill at 60 rotations per minute (RPM) and 2 ton (2000 kg) weight on bit (WOB) in limestone, at a downhole pressure of 6 MPa. The ROP measured as a function of the HSI is given in Table 2.

TABLE 2

| HSI (kW/cm$^2$) | ROP (m/hr) |
|---|---|
| 0.2 (0.023) | 0.22 |
| 0.8 (0.091) | 0.19 |
| 1.8 (0.21) | 0.18 |
| 3.4 (0.39) | 0.16 |

The experiments show that also for a tricone bit the rate of penetration is uniquely related to nozzle fluid flow. Differently from a PDC bit, however, ROP decreases with increasing nozzle fluid flow. The reason is thought to be found in different pressure and recoil effects due to different bit face geometries near the nozzle outlets.

It is irrelevant whether ROP increases or decreases with nozzle fluid flow. In both cases a directional drilling effect can be achieved with proper control of differential fluid flow through nozzles. Only the sign of the directional effect differs which can be taken into account in the control.

In both experiments a unique relationship between ROP and HSI was found. In principle the size of the directional effect could be controlled by controlling the differential fluid flow through the nozzles using a pre-calibrated dependency. In a simpler and more robust embodiment, the differential fluid flow is selected such that the directional drilling effect is larger than what can be accommodated by the bottom hole assembly of the drill string. Typically, a centralizer some distance behind the drill bit determines the minimum radius that can be drilled. If the directional drilling effect is stronger, the minimum radius determined by the BHA will be drilled. A larger radius can be drilled by selectively switching on and off the directional drilling.

If no directional drilling is desired, this can be achieved by taking the flow diverter out of a geostationary position, such that a straight hole is drilled. This is for example the case if the flow diverter rotates together with the drill bit.

Due to the simplicity of the directional control concept of the present invention, it can be applied for a wide range of drill string diameters. For instance for drill string diameters of about 5 cm, 6 cm, 10.5 cm, 15.2 cm, 21.6 cm, and larger.

The invention is not limited to the embodiments described above, wherein various modifications are conceivable within the scope of the appended claims. Features of respective embodiments may for instance be combined.

The invention claimed is:

1. An insert for a drill bit of a rotational directional drilling system, the insert comprising:

a cylindrical body provided with an internal fluid passage and adapted to be arranged within an intermediate space of the drill bit for receiving drilling fluid from a drill string and selectively directing the drilling fluid to nozzles of the drill bit, the insert having a downhole end and an upper end, of which the downhole end is provided with an eccentric fluid opening and of which the upper end is provided with a protruding flange which provides a shoulder for engaging a top end of a pin type threaded coupling of the drill bit.

2. The insert of claim 1, comprising a connector to connect the insert to a first rotor section of a directional drilling system, the insert being rotatable with respect to the drill bit.

3. The insert of claim 2, comprising a flow diverter for diverting the drilling fluid with respect to an axis of the cylindrical body.

4. The insert of claim 1, the cylindrical body being provided with a fluid channel for diverting the drilling fluid.

5. The insert of claim 4, the fluid channel having the eccentric fluid opening.

6. The insert of claim 4, wherein the fluid channel extends eccentrically with respect to the axis of the cylindrical body.

7. The insert of claim 1, the insert being adapted to be fixated in the intermediate space of the drill bit.

8. The insert of claim 7, the insert comprising at least two tubes, each tube having a first end connected to the cylindrical body, said first end adapted to receive the drilling fluid, and a second end adapted to extend towards a corresponding one of the at least two fluid nozzles of the drill bit.

9. The insert of claim 8, comprising a flow diverter which is rotatable with respect to the cylindrical body and is arranged adjacent to said first end of the at least two tubes.

10. The insert of claim 1, wherein the drill bit is a rotary drill bit, selected from the group of: PDC bit and roller cone bit.

11. A method for directional drilling of a borehole in a formation, the method comprising the steps of:

providing a drill bit comprising an intermediate space;

providing an insert having a downhole end and an upper end, of which the downhole end is provided with an eccentric fluid opening and of which the upper end is provided with a protruding flange which provides a shoulder for engaging a top end of a pin type threaded coupling of the drill bit;

inserting the insert in the intermediate space of the drill bit; and selectively directing the drilling fluid to nozzles of the drill bit.

12. The method of claim 11, comprising the step of:

connecting the insert to a first rotor section of a directional drilling system; and rotating the insert with respect to the drill bit and in conjunction with the first rotor section.

13. The method of claim 11, comprising the step of fixating the insert in the intermediate space; and selectively directing the drilling fluid to fluid passages of the insert.

14. The method of claim 13, wherein the step of fixating includes filling the intermediate space of the drill bit with a hardening polymer material.

15. The method of claim 11, comprising the step of introducing the insert in the drill bit at a drilling site or drilling rig.

* * * * *